US007446712B2

(12) United States Patent
Itoh et al.

(10) Patent No.: US 7,446,712 B2
(45) Date of Patent: Nov. 4, 2008

(54) COMPOSITE RIGHT/LEFT-HANDED TRANSMISSION LINE BASED COMPACT RESONANT ANTENNA FOR RF MODULE INTEGRATION

(75) Inventors: Tatsuo Itoh, Rolling Hills, CA (US); Cheng-Jung Lee, Los Angeles, CA (US); Kevin M. Leong, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 5 days.

(21) Appl. No.: 11/614,017

(22) Filed: Dec. 20, 2006

(65) Prior Publication Data

US 2007/0176827 A1 Aug. 2, 2007

Related U.S. Application Data

(60) Provisional application No. 60/752,810, filed on Dec. 21, 2005.

(51) Int. Cl.
*H01Q 1/38* (2006.01)

(52) U.S. Cl. ..... 343/700 MS; 343/749; 343/754; 343/909

(58) Field of Classification Search ..... 343/700 MS, 343/909, 754, 846, 749
See application file for complete search history.

(56) References Cited

U.S. PATENT DOCUMENTS

| | | | | |
|---|---|---|---|---|
| 6,426,722 | B1 * | 7/2002 | Sievenpiper et al. | 343/700 MS |
| 6,552,696 | B1 * | 4/2003 | Sievenpiper et al. | 343/909 |
| 7,196,666 | B2 * | 3/2007 | Allen et al. | 343/700 MS |
| 2006/0145927 | A1 * | 7/2006 | Choi et al. | 343/700 MS |

* cited by examiner

*Primary Examiner*—Hoang V Nguyen
(74) *Attorney, Agent, or Firm*—John P. O'Banion

(57) ABSTRACT

An apparatus based on composite right-handed or left-handed (CRLH) principles to provide a transmission line or antenna structure having a plurality of cells to which one or more feed ports are attached. The apparatus is based on an equivalent circuit Right-Hand (RH) series induction ($L_R$) and shunt capacitor ($C_R$), and Left-Hand (LH) series capacitor ($C_L$) and induction ($L_L$), in which effective permittivity (e) and permeability (m) of the structure are manipulated by the choice of $C_R$, $L_R$, $C_L$, and $L_L$. One embodiment describes mushroom antenna cells (1D or 2D array) in which vias extend up from a feed network on a ground plane through at least one dielectric region to each of a first plurality of conductive elements (plates or strips). Optionally, a second plurality of conductive elements are disposed between first and second dielectric layers to form metal-insulator-metal (MIM) capacitors to lower resonance frequency.

31 Claims, 19 Drawing Sheets

COMPOSITE RIGHT/LEFT-HANDED TRANSMISSION LINE BASED COMPACT RESONANT ANTENNA FOR RF MODULE INTEGRATION

CROSS-REFERENCE TO RELATED APPLICATIONS

This application claims priority from U.S. provisional application Ser. No. 60/752,810 filed on Dec. 21, 2005, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to antennas, and more particularly to compact transmission line antennas.

2. Description of Related Art

Portable devices have become one of the necessary appliances for our daily lives. To conveniently carry these portable devices such as cell phones, media players and laptops, they are designed to be compact and lightweight, without sacrificing performance or functionality. The challenge to implement such small devices is to mount all the necessary circuits onto a small highly integrated transceiver unit. Among all the components, the antenna is one of the most challenging to scale down in size because the size of conventional antennas depends on operating frequency which is usually in the MHz or low GHz range. The traditional half-wavelength antenna cannot be incorporated in the space-limited RF front-end modules. Therefore, many researchers are investigating different methods to realize small antennas.

It has been shown that a reactive load attached to an antenna can lower the operating frequency and thus reduce the size of the antenna. Internal antennas including the Planar Inverted-F Antenna (PIFA) and chip antennas have also attracted attention because of their ease of integration with RF modules. The PIFA size can be reduced by several methods such as using a capacitive load or increasing the current flow path. In addition, the use of monopoles with circular disks loaded at the end, or the helix dipole antenna with spiral arm, have been shown to enhance impedance bandwidth within a compact size.

Recently, metamaterial based transmission lines have been developed and have been shown to exhibit unique features of anti-parallel phase and group velocities with a zero propagation constant at a given frequency for the fundamental operating mode. These metamaterials have been used to realize novel planar antennas, such as those exhibiting zeroeth-order resonant mode, which is characterized as having an infinite wavelength. In this case, the transmission line length is independent of the resonant phenomena, thus enabling physical size reduction. Zeroeth order resonators are described by inventors Tatsuo Itoh, Atsushi Sanada and Christophe Caloz in U.S. patent application Ser. No. 11/092,143 filed on Mar. 28, 2005, and published on Mar. 30, 2006 as U.S. patent application publication No. U.S. 2006/0066422 A1, both of which are incorporated herein by reference in their entirety.

In addition, the use of an L-C loaded transmission line has been used to create a $\lambda/2$ field distribution, where $\lambda$ is the free space propagating wavelength, over a shorter line length to realize a smaller patch antenna and slot antenna compared to conventional antennas. Another method to reduce antenna size relies on the possibility of filling a cavity with a pair of double-negative, double-positive and/or single negative material blocks to synthesize the sub-wavelength cavity resonator.

None of these attempts, however, have been entirely successful at reducing antenna size without unduly sacrificing gain and other positive antenna characteristics.

Accordingly, a need exists for an antenna apparatus that can be implemented in a compact size while providing a high level of gain. These needs and others are met within the present invention, which overcomes the deficiencies of previously developed antenna structures.

BRIEF SUMMARY OF THE INVENTION

A number of implementations of electrically small resonant antennas employing the Composite Right/Left-Handed transmission line (CRLH-TL) are presented which are particularly well-suited for integration with portable RF modules. The prototype antenna designs are based on the unique property of anti-parallel phase and group velocity of the CRLH-TL at its fundamental mode. In this mode of the RF apparatus, the propagation constant increases as the frequency decreases, wherein, a small guided wavelength can be obtained at a lower frequency to provide the small $\lambda_g/2$ resonant length used to realize a compact antenna design, where $\lambda_g$ is the guided wavelength. Furthermore, the physical size and operational frequency of the antenna depend on the unit cell size and the equivalent transmission line model parameters of the CRLH-TL, including series inductance, series capacitance, shunt inductance and shunt capacitance. Optimization of these parameters as well as miniaturization techniques of the physical size of the unit cell is discussed. An implementation describes an array configuration in which N unit cells are cascaded to implement a compact CRLH-TL structure with a zeroeth order resonance, N−1 Left-Handed (LH) low-frequency resonances, and N−1 Right-Handed (RH) higher-frequencies resonances.

A four unit-cell resonant antenna was designed and tested at 1.06 GHz, having a length, width and height of $1/19\lambda$, $1/23\lambda$ and $1/83\lambda$, respectively. In addition, a compact antenna using a 2-D cell arrangement is exemplified as a three-by-three unit-cell, referred herein as being a "mushroom shape" or "mushroom-like" in deference to its general platform comprising a planar cap attached to an elongate stalk. One such mushroom antenna developed at 1.17 GHz was found to provide an increased gain, while higher radiation efficiencies are expected as these implementations move beyond this first prototype stage.

Similar methods are then applied in the development of a circularly polarized antenna operating at 2.46 GHz. An example implementation of the antenna provides a 116° beamwidth with an observed axial ratio of better than 3 dB. The physical size of the prototype mushroom-type small antenna and the circularly polarized antenna is 1/14λ by 1/14λ by 1/39λ and 1/10λ by 1/10λ by 1/36λ, respectively.

As an aid to understanding the present invention, information follows about some of the terms utilized within the specification and claims. However, it is to be appreciated that this information is provided for convenience and not as a substitute for other recitations within the specification and claims.

"Mushroom", or "mushroom-type", antenna are terms describing a general construction topography for the antennas described herein, which have a cap formed with a conductive element, such as a plate or strip, and a stalk formed with a conductive via. Each of the conductive plates or strips is separate from one another, said another way they are non-overlapping, wherein an air or material dielectric separates the plates or strips.

"Electrically small" in reference to an antenna is a term that compares the actual sizing of the antenna to its wavelength. It will be appreciated that conventional antenna designs operate at a given portion of the operating wavelength or fundamental frequency, such as 1/4λ, 1/2λ, 5/8λ, and so forth. "Electrically small" refers to the size of the antenna in relation to its wavelength and in comparison with traditional antenna forms.

It is to be appreciated that the three antennas mentioned above were built using University of California at Los Angeles (UCLA) limited manufacturing capabilities such as adding the second thin dielectric layer by gluing it to the main first layer using lossy epoxy-based glue ("Crazy glue"). it has been found that gain, efficiency, and return loss of these antennas is further improved by utilizing more accurate manufacturing capabilities. Additional techniques have been identified which provide operating improvements, such as the following techniques. Instead of using standard copper wire to build the vias in the so called mushroom unit cell, a high-quality silver-coated copper wire is preferably utilized. Another technique consists of creating vias by electroplating the holes in the substrate with copper according to high-quality manufacturing processes instead of drilling holes in the substrate, inserting standard (off-the-shelf ) copper wire, and then solder the copper wire to the top and bottom metal surfaces.

The invention is amenable to being embodied in a number of ways, including, but not limited to, the following descriptions.

One implementation is an apparatus for transmitting or radiating radio frequencies within a composite right/left-handed (CRLH) transmission line, comprising: (a) at least one dielectric layer; (b) a first plurality of separate conducting elements upon the dielectric layer; and (c) means for guiding a signal along waveguides within the plane of a ground plane, proximal the dielectric layer, and up through a vertical conductor, passing through the dielectric layer, and connecting to at least one of the separate conducting elements within the first plurality of separate conducting elements. It should be noted that the apparatus can be implemented as an antenna when the signal is radiated from the apparatus, or a transmission line when the signal is transmitted through the apparatus.

In a variation of the above implementation at least two dielectric layers are utilized, comprising: (d) a first dielectric layer in a first thickness and with a first dielectric constant as a substrate base; (e) a second dielectric layer positioned over the first dielectric layer and having a second thickness and second dielectric constant; wherein the first plurality of conducting elements is positioned over the second dielectric layer and the vertical conductor passes through both the first and second dielectric layer; (f) a second plurality of separate conductive elements retained between the first and the second dielectric layers; (g) a plurality of metal-insulator-metal (MIM) capacitors formed in response to the proximal relation of the second plurality of conductive elements in relation to the first plurality of separate conductive elements; and wherein the MIM capacitors are configured to lower the resonant frequency of the apparatus.

In one implementation of the above, the second dielectric constant is higher than the first dielectric constant, and/or the second thickness is less than the first thickness.

One implementation is an apparatus for transmitting or radiating radio frequencies within a composite right/left-handed (CRLH) transmission line, comprising: (a) a first dielectric layer forming a structure substrate; (b) a second dielectric layer positioned over the first dielectric layer; (c) a ground plane disposed under the first dielectric layer; (d) a first plurality of conductive elements disposed over the second dielectric layer; (e) a second plurality of conductive elements disposed between the first and second dielectric layers and positioned to form metal-insulator-metal (MIM) capacitors in response to proximity with the first plurality of conductive elements wherein the capacitors lower the resonant frequency of the apparatus; (f) a plurality of vias interconnecting the first plurality of conductive elements with the ground conducting layer; and (g) at least one feed line attached to the first plurality of conductive elements. Optionally, a second feed line can be added, orthogonal to the first, wherein the apparatus becomes circularly polarized.

One implementation is an antenna formed as a composite right/left-handed (CRLH) transmission line, comprising: (a) means for defining a plurality of separate antenna elements upon a dielectric substrate; and (b) means for guiding a signal along waveguides within the plane of a ground plane and up through a conductor, passing through the dielectric substrate, and connecting to at least one of the separate antenna elements (or the converse direction). Optionally, a plurality of separate conductive elements can be disposed within the substrate, or between a first dielectric and second dielectric comprising said substrate. The additional conductive elements form metal-insulator-metal (MIM) capacitors in relation with the plurality of separate antenna elements to lower antenna resonant frequency.

The antenna can be fabricated as single cells or more preferably as one-dimensional or two-dimensional arrays. The conductive elements (antenna element and optional MIM capacitor elements) are preferably formed from planar conductive strips (elongate shapes) or plates (typically square or similarly shaped). The antennas can be fabricated over a range of sizing and are particularly well-suited for use on antennas in the range of frequencies between approximately hundreds of MHz and tens of GHz, and most preferably in the low GHz ranges.

It should be noted that the vias connected between the ground layer and the top conductive elements (antenna elements), are preferably connected to the centers of each antenna element, though they may be connected non-symmetrically, in response to connection by off-center vias.

In one implementation, the feed line is configured for dual-feed of the antenna array, such as using microstrip, to make the antenna circularly polarized. The feed lines are preferably connected to orthogonal antenna edges.

The CRLH-TL antennas described can be fabricated with any desired materials and techniques, such as conventional dielectric substrates, conducting metal sheets, feed lines, coplanar waveguides, and ground planes. The effective permittivity (e) and permeability (m) of the structure are manipulated by the choice of $C_R$, $L_R$, $C_L$, and $L_L$.

The teachings herein are particularly well-suited for use on antenna components, however, one of ordinary skill in the art should appreciate that the structures described herein can be alternatively configured for transmission of RF signals by adding one or more output ports. Accordingly, the benefits of these structures are not strictly limited to antenna components.

The composite Right/Left-Handed transmission line (CRLH-TL) structures taught herein may be utilized to provide for RF radiation and/or transmission within a wide variety of RF components or systems.

The present invention can provide a number of beneficial aspects which can be implemented either separately or in any desired combination without departing from the present teachings.

An aspect of the invention is to provide a high-gain antenna within a compact form factor (electrically small).

Another aspect of the invention is to provide an antenna design that utilizes anti-parallel phase and group velocities within a composite right-hand, left-hand transmission line antenna.

Another aspect of the invention is to provide an antenna having embedded series capacitor elements to reduce size and optimize operation.

Another aspect of the invention is to provide an antenna design that can be circularly polarized.

Another aspect of the invention is to provide an antenna that can operate at a number of different modes with respect to operating frequency.

Another aspect of the invention is to provide an antenna that can be implemented in either one or two dimensional arrays.

A still further aspect of the invention is to provide an antenna that can be fabricated from planar substrate materials.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 28. It will be appreciated that the apparatus may vary as to configuration and as to details of the parts without departing from the basic concepts as disclosed herein.

1. Introduction.

The teachings herein describe the concepts and implementation of resonant antennas (and transmission lines) which operate in the left-handed (LH) region (β is negative). The present invention adds to the concept of using LH transmission lines to create antennas. The antenna structure taught herein is based on a Composite Right/Left Handed (CRLH) transmission line (TL) model used as a periodic structure. The propagation constant approaches negative infinity at the cutoff frequency, because the lowest mode of operation is an LH mode, and reduces its magnitude as frequency is increased. Making use of this phenomenon, an electrically large, but physically small, antenna is described. The LH dispersion relation of the CRLH-TL is manipulated by adjusting the equivalent circuit parameters of its unit cell. By changing the inductance and capacitance values, the dispersion curve of the CRLH-TL can be engineered.

2. CRLH Transmission Line Theory.

It is known that a purely LH-TL cannot be realized because of unavoidable parasitic effects which contribute to RH modes. This realization has lead to the development of the CRLH-TL which represents a transmission line having both LH and RH contributions.

Figure 1:
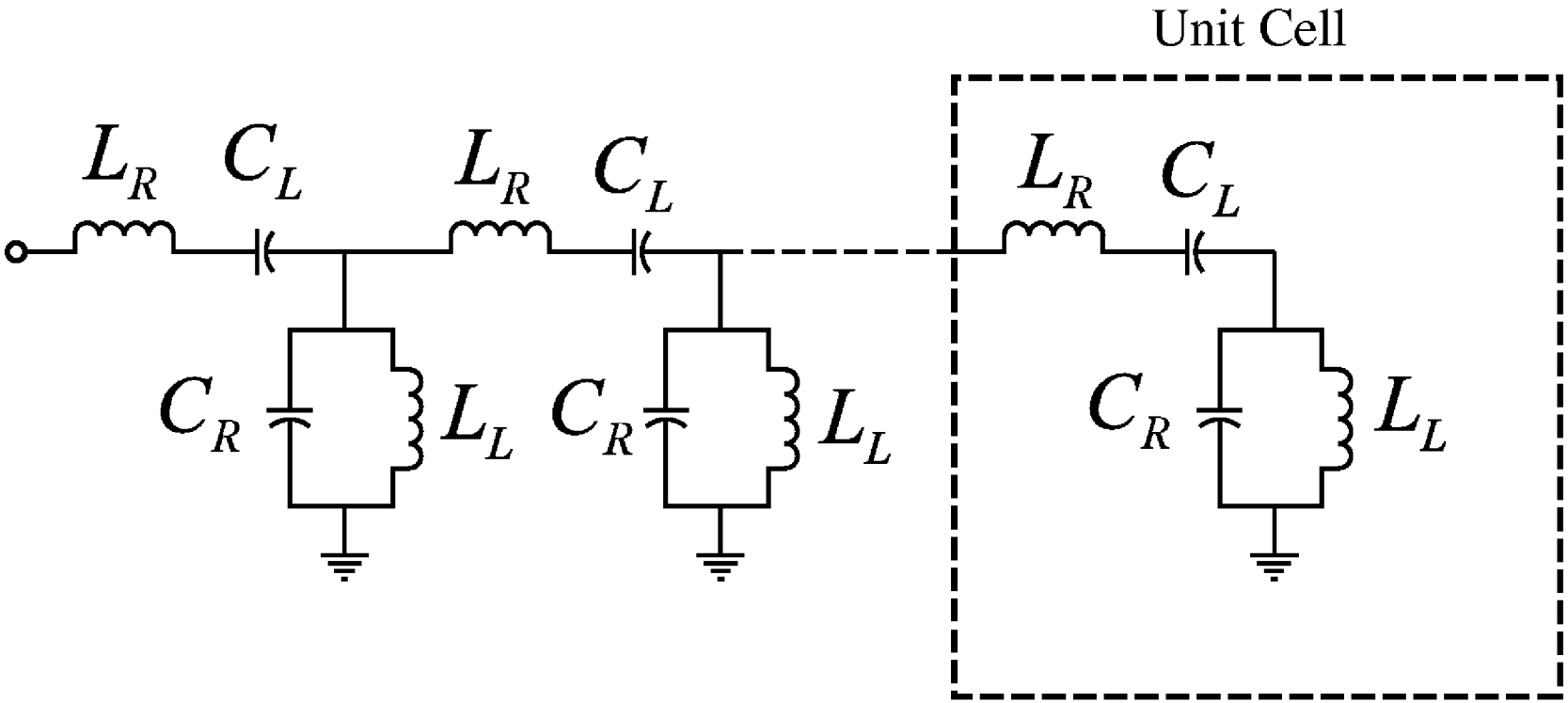
FIG.1 is a schematic of the infinitesimal equivalent circuit model of the composite right-hand, left-hand transmission line (CRLH-TL).

FIG. 1 shows the infinitesimal equivalent circuit model of the CRLH-TL.

Basically, each unit cell in this periodic structure consists of LH shunt inductance ($L_L$) and LH series capacitance ($C_L$) as well as parasitic RH series inductance ($L_R$) and RH shunt capacitance ($C_R$).

Figure 2:
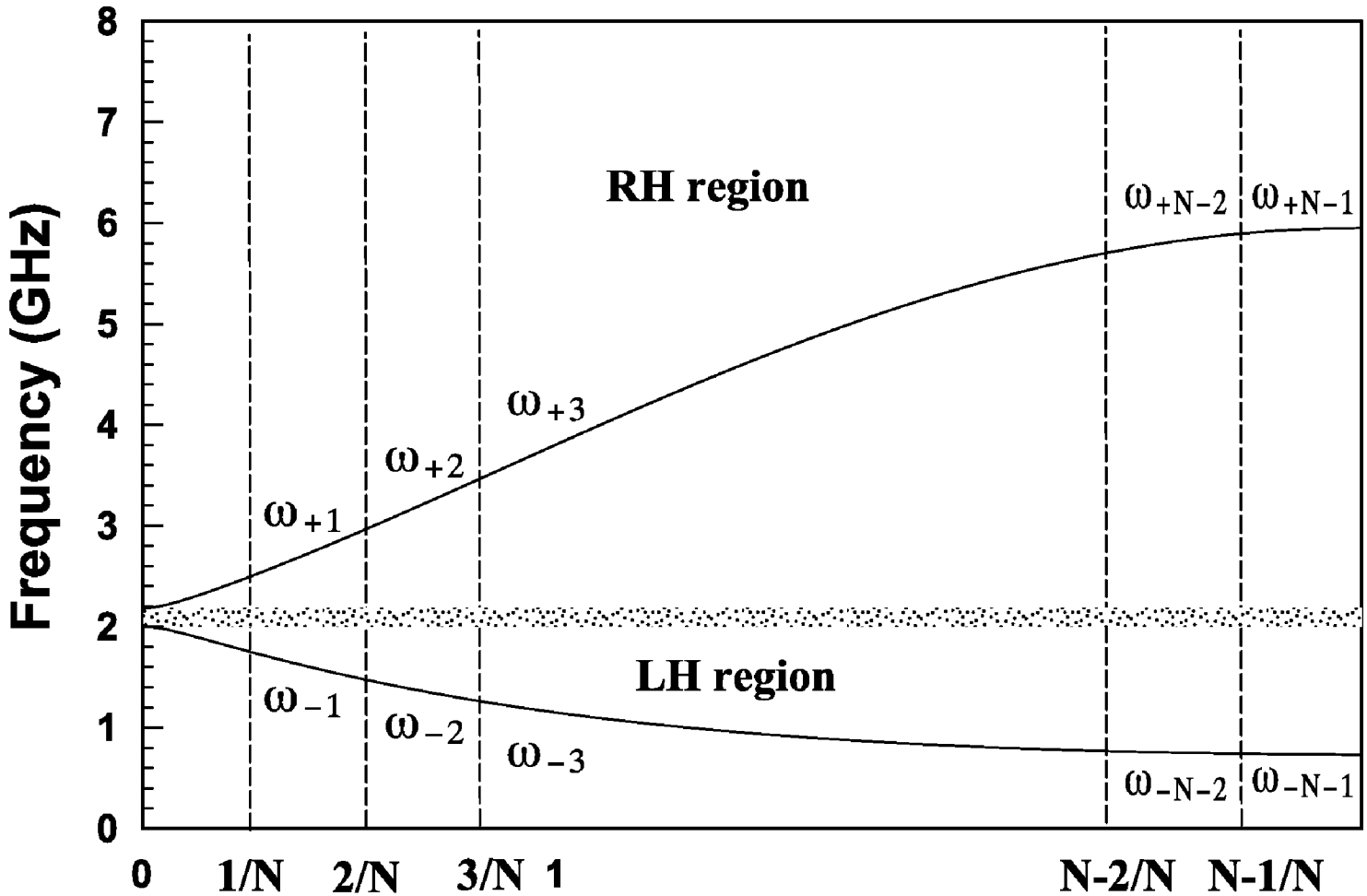
FIG. 2 is a graph of dispersion for the CRLH-TL with respect to frequency for a single unit cell of the antenna.

FIG. 2 illustrates the 1-D dispersion relation of the CRLH-TL based on the equivalent circuit parameters of one unit cell. This can be calculated by applying the Bloch-Floquet periodic boundary condition and using ABCD matrix of one unit cell:

$$\beta(\omega)\rho = \cos^{-1}\left(1 + \frac{Z(\omega)\cdot Y(\omega)}{2}\right) \text{ where} \tag{1}$$

$$Z(\omega) = j\left(\omega L_R - \frac{1}{\omega C_L}\right) \text{and } Y(\omega) = j\left(\omega C_R - \frac{1}{\omega L_L}\right)$$

wherein, β is the propagation constant and ρ is the period length of the periodic structure.

In FIG. 2, β(ω)ρ is normalized to π in the horizontal axis. The dispersion curve can be broken down into two regions, corresponding to the RH mode (β>0) and the LH mode (β<0) respectively. In the figure both regions are plotted on the positive β axis for convenience. Notice that these two curves are bounded by a bandgap and two cutoff frequencies determined by the RH circuit elements within the unit cell (low pass filter) and LH circuit elements within the unit cell (high pass filter). The center bandgap is determined by the series and shunt resonant frequencies. However, when the ratio of $L_R$ and $C_R$ is equal to the ratio of $L_L$ and $C_L$ the bandgap is eliminated. The series resonant frequency, shunt resonant frequency, and two cutoff frequencies are defined as follows:

$$\omega_{series} = \frac{1}{\sqrt{L_R C_L}} \tag{2}$$

$$\omega_{shunt} = \frac{1}{\sqrt{L_L C_R}} \tag{3}$$

$$\omega_{cutoff,RH} \cong \frac{2}{\sqrt{L_R C_R}} \tag{4}$$

$$\omega_{cutoff,LH} \cong \frac{1}{2\sqrt{L_L C_L}} \tag{5}$$

Based on the above equations, the upper bound of the bandgap can be either the series or the shunt resonant frequency, and depends on the value of the equivalent circuit parameters. A CRLH-TL can be constructed by cascading N unit cells with period ρ and the total length L of the transmission line will be N times ρ. In the RH region, the transmission line is dominated by $L_R$ and $C_R$ and acts like a conventional transmission line. The propagation constant will become larger as the frequency increases which implies the wavelength becomes smaller with increasing frequency. In contrast, in the LH region, the characteristics of the CRLH-TL are primarily determined by $L_L$ and $C_L$ where β is negative. In this region the propagation constant will approach infinity at frequencies near the lower cutoff yielding small antennas resonating at low frequencies.

For an open-ended transmission line, the resonant condition of $\beta_n = \pm n\pi/L$ should be satisfied where n can be 0, ±1, ±2 . . . ±(N−1). As a result, 2N−1 resonant frequencies represented as $\omega_{\pm n}$ in both RH and LH region can be expected.

In order to realize a resonant antenna within a small size, the dispersion curve of the LH portion must be designed to have a very large β at a low frequency.

Figure 3:
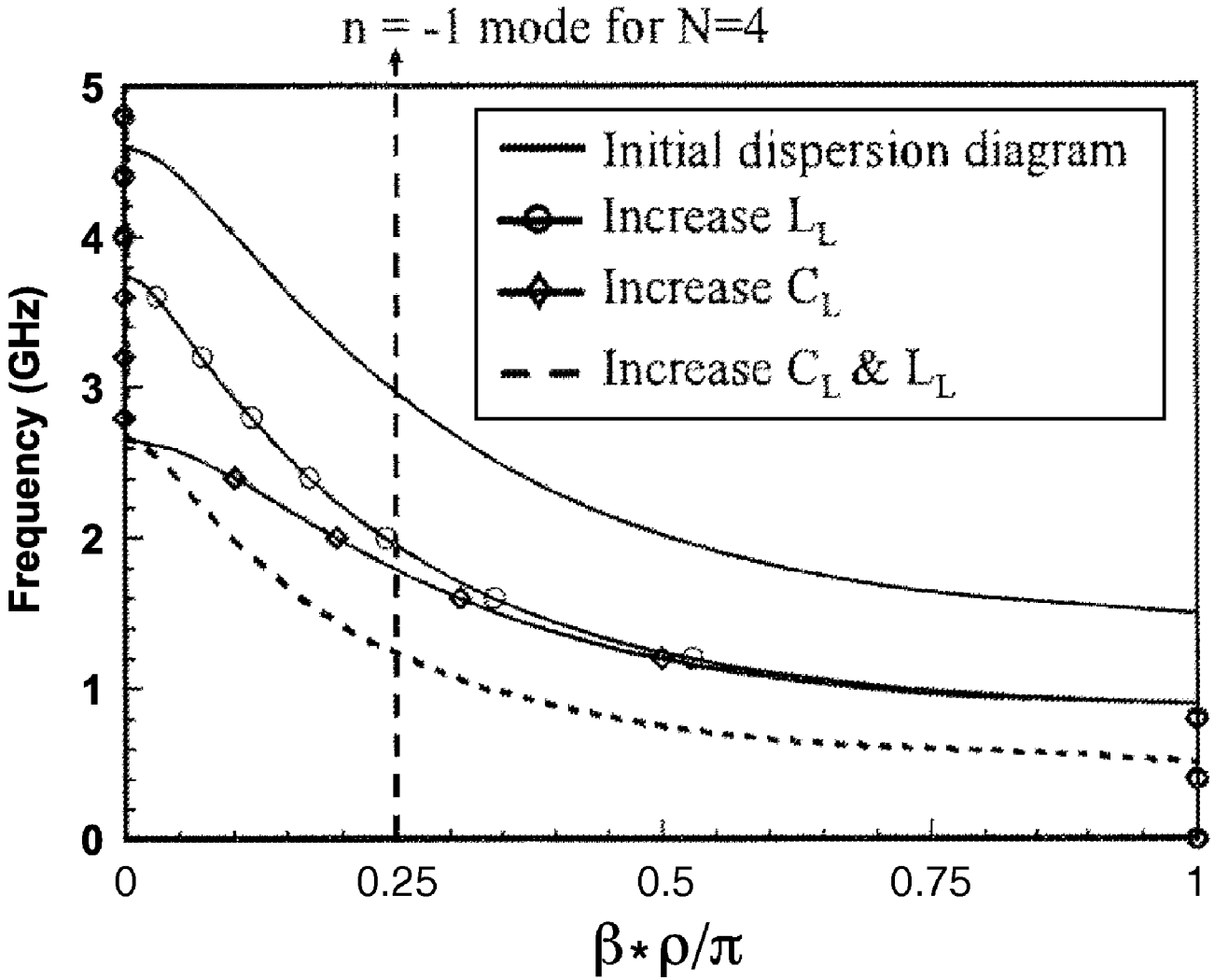
FIG. 3 is a graph of comparative dispersion for the CRLH-TL configuration as a baseline and three plots in which $L_L$ is increased, $C_L$ is increased, and both $L_L$ and $C_L$ are increased.

FIG. 3 illustrates a dispersion curve comparison based on different circuit parameters in the LH region. The figure depicts an initial dispersion plot of the LH mode of the CRLH-TL shown as the solid line where the point at β=0 is $\omega_{shunt}$. The other three curves represent the dispersion relation when $L_L$ is increased, $C_L$ is increased, and both $L_L$ and $C_L$ are increased, while the other parameters remain unchanged. When $L_L$ is increased, as represented by Eq. 3 and Eq. 5, the shunt resonant frequency and the LH cutoff frequency will be decreased. When $C_L$ is increased, the point where β=0 will interchange to $\omega_{series}$ because the product of $L_R C_L$ is larger than the product of $L_L C_R$. Also, the $\omega_{series}$ and LH cutoff frequency will be decreased in this case.

It should be noted that, if both $L_L$ and $C_L$ are enlarged, the dispersion diagram as shown is carried to an even lower frequency band. For example, for an N=4 structure, the reduction in frequency for the n=−1 mode can be observed with changing unit cell parameters. For these conditions, resonance will occur when βρ/π=1/N=0.25. Notice that the operational frequency will be reduced from 3 GHz to 1.2 GHz as the series capacitance and shunt inductance are increased. Consequently, if the physical size of the unit cell can remain small and the value of $L_L$ and $C_L$ can be elevated simultaneously, a small resonant antenna can be realized by using a CRLH-TL section at the frequency of a resonant condition. The resulting structure size will be a small fraction of the free space wavelength λ.

3. Design of Small Antenna Prototype.

In order to realize a small antenna based on CRLH-TL, the implementation of a compact circuit with a small unit cell but large $L_L$ and $C_L$ is crucial. These issues will be discussed in the following sub-sections as well as actual design and testing of the antenna prototype.

A. Design of Unit Cell

It is understood that several implementations can be used to realize the CRLH-TL unit cell including surface mount technology (SMT) chip components and distributed lines. Both approaches have been demonstrated to successfully approximate the LH properties and have been used to implement devices in the microwave region. However, lumped elements are not generally appropriate in antenna design because of their lossy characteristics and discrete values. Printed planar structures have also been considered. However, the CRLH-TL realized by interdigital capacitor and shorted stub cannot provide a large series capacitance and inductance in a small area. Another structure is the mushroom structure which was first developed by Sievenpiper et al. to construct high-impedance electromagnetic 2-D surfaces. This unit cell structure consists of a square patch over a ground plane and a via connecting the center of the patch to the ground.

The unit cell for the compact antenna designs taught herein are based on a modified mushroom structure unit cell. Since only a 1-D resonant condition is needed for the antenna application, the mushroom-like structure does not necessarily need to be symmetric. In addition, the coupling between adjacent edges of the conventional mushroom structure cannot achieve the desired large capacitance.

Figure 4:
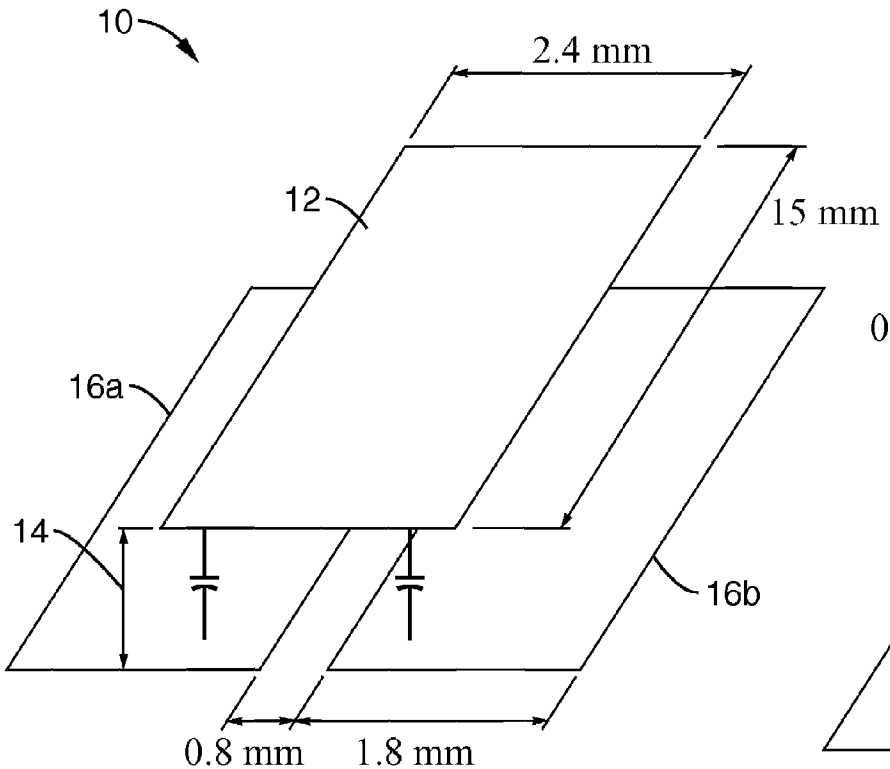
FIG. 4 is a perspective view of a metal-insulator-metal (MIM) series capacitor according to an aspect of the present invention.

FIG. 4 illustrates a mushroom shaped structure 10 which incorporates a series capacitor. One preferred implementation of the series capacitor is as a metal insulator metal (MIM) capacitor that overcomes a number of shortcomings identified above. An upper conductive plate 12 is shown vertically separated 14 from adjacent underlying conductive plates 16*a*, 16*b*, with capacitance symbols indicating the presence of capacitance between the vertically separated plates. Dimensions are shown for a particular embodiment of this structure, however, it should be appreciated that the shape and sizing of the elements depends on the application as well as the wavelength. Preferably, the vertical separation between upper and lower conductive plates comprises the interposition of a solid dielectric material. The metal insulator metal (MIM) capacitor is thus implemented spanning, for example, a thin portion of a high dielectric constant substrate to increase $C_L$.

Figure 5:
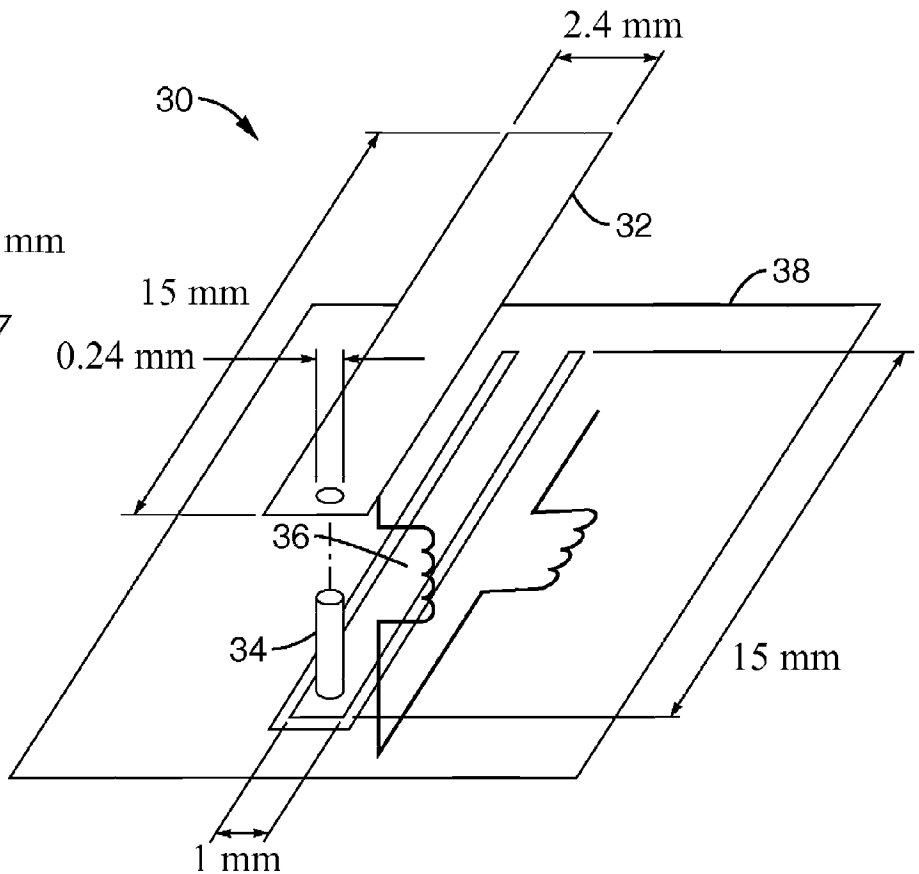
FIG. 5 is a perspective view of a shunt inductance within the CRLH cell according to an aspect of the present invention, showing a coplanar wavelength (CPW) stub.

FIG. 5 depicts the realization of a shunt inductance $L_L$, which consists of a metallic via with additional CPW stub connected to the ground. The via length and CPW length can be enlarged to increase the shunt inductance. The figure illustrates a first conductive element 32 connected through via 34 to a CPW stub 36 within a ground plane 38, such as positioned adjacent the underside of the substrate.

A small unit cell having large values of $C_L$ and $L_L$ can be implemented according to the present invention in response to combining the MIM capacitor of FIG. 4 with the CPW stub of FIG. 5. It should also be appreciated that the antenna (or transmission line), can be implemented as shown in FIG. 5 without the capacitors shown in FIG. 4, however, the resulting antenna would not be as compact.

Figure 6:
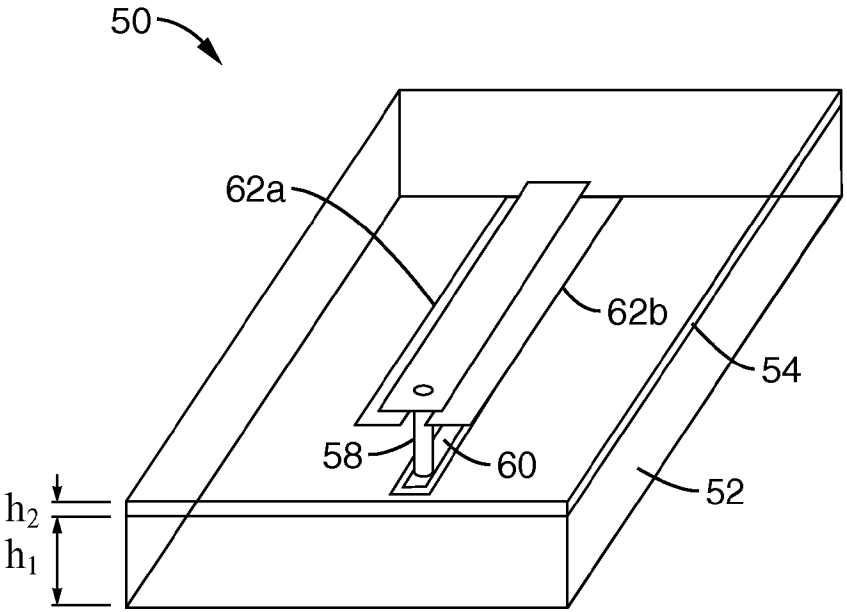
FIG. 6 is a perspective view of a CRLH-TL antenna unit cell according to an aspect of the present invention, showing conductive strips particularly well-suited for use in a one-dimensional array of unit cells within the antenna.

FIG. 6 shows the configuration of a CRLH-TL antenna unit cell 50 which combines the structure shown in FIG. 4 and FIG. 5. This multi-layer structure consists of two substrates 52, 54, an upper conductive region (strip) 56 is connected through a conductive via 58, with a CPW stub 60 within a ground plane. It should be appreciated that alternative ground plane configurations can be adopted, such as solid or mesh ground planes with or without CPW stubs, although this will alter operational characteristics. Conductive regions (strips) 62*a*, 62*b* are shown disposed between first dielectric layer 52 and second dielectric layer 54 to incorporate MIM capacitors. In a preferred embodiment, the upper substrate layer 54 comprises a thin dielectric material having a high dielectric constant (e.g., $\epsilon_{r2}$=102, $h_2$=0.254 mm) and the lower substrate portion comprises a thick dielectric material having a low dielectric constant (e.g., $\epsilon_{r1}$=2.2, $h_1$=3.16 mm).

In one implementation, metal layers are formed on each side of the upper substrate with another metal layer formed on the bottom side of the lower substrate acting as the microstrip ground plane. By way of example and not limitation the metal layers can be formed by printing, etching, sputtering, machining, bonding, or by being otherwise retained in position by other techniques or combinations of techniques. The MIM capacitor implemented by the parallel microstrip lines on the upper layer and the coupling gap establish series capacitance ($C_L$). It will be appreciated that multiple layers of dielectric and/or conductive elements can be utilized as desired without departing from the teachings of the invention. The metallic via which accompanies the CPW stub acts as a shunt inductor. A CRLH-TL can therefore be realized by cascading the unit cell periodically. Full-wave simulation was used to extract the following circuit parameters for the unit cell: $L_R$=0.78 nH, $C_R$=1.25 pF, $L_L$=7.6 nH and $C_L$=3.2 pF.

B. Verification of Resonant Frequencies.

Figure 7:
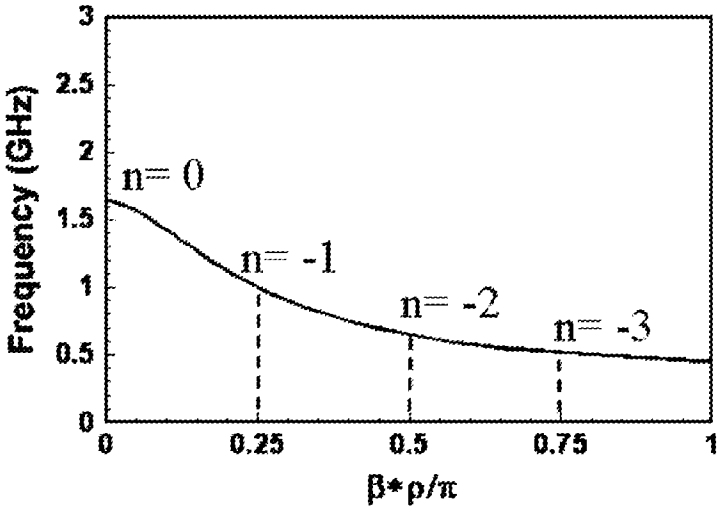
FIG. 7 is a graph of dispersion relation with respect to frequency for the modes of a four unit cell one-dimensional array according to an aspect of the present invention, having $L_R$=0.78 nH, $C_R$=1.25 pF, $L_L$=7.6 nH and $C_L$=3.2 pF.

FIG. 7 plots the dispersion relation of the unit cell based on the equivalent circuit parameter extracted from the full-wave simulation. For a four unit cell structure (N=4) the predicted resonant frequencies are 1.65 GHz, 0.95 GHz, 0.65 GHz and 0.52 GHz corresponding to n=0, n=−1, n=−2, and n=−3 modes, respectively.

Figure 9:
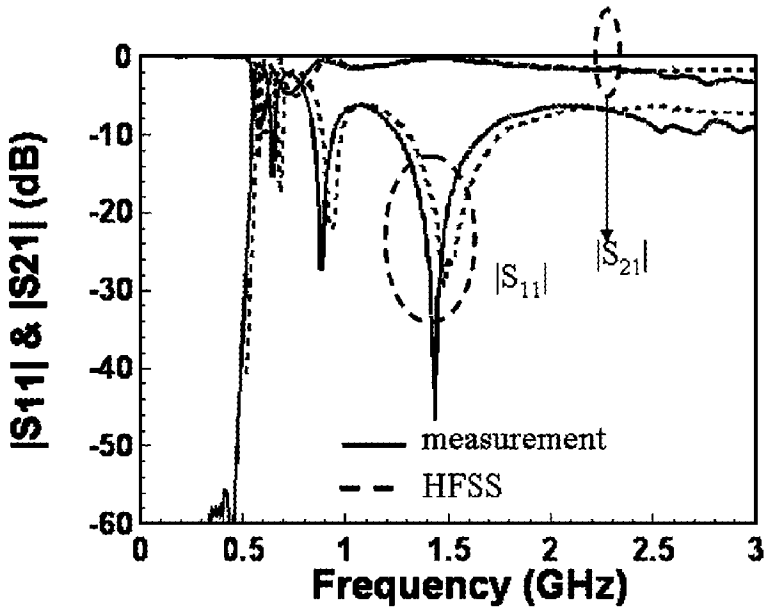
FIG. 9 is a graph of resonant frequency predictions from full-wave simulation (HFSS) and measurements according to an aspect of the present invention.
Figure 8:
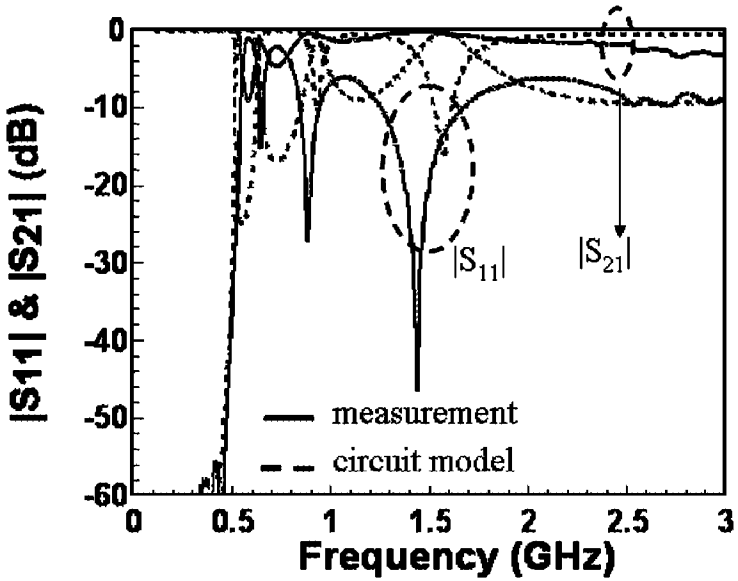
FIG. 8 is a graph of resonant frequency predictions from the circuit model and measurements according to an aspect of the present invention.

FIG. 8 and FIG. 9 show the predicted resonant frequencies of the four unit cell resonator calculated using the circuit model and Ansoft HFSS simulation compared with measurement. The full-wave simulation agrees well with the measured results, however, the circuit model predicts slightly different resonant frequencies. This deviation may be attributed to the inaccurate circuit parameters extracted from the simulation. However, as expected, all the results indicate that four possible resonant frequencies exist in this resonant structure. From the measured results, the resonant frequencies of 1.44 GHz, 0.9 GHz, 0.65 GHz and 0.51 GHz corresponding to the n=0, n=−1, n=−2, and n=−3 modes, respectively, can be obtained.

C. Antenna Design.

An implementation for a small resonant antenna operating at n=−1 mode, thus implying a half-wavelength field distribution, was designed. This mode is chosen to provide maximum excitation of the antenna area providing higher antenna gain, radiation efficiency, better impedance matching and existence of only one main beam.

Figure 10:
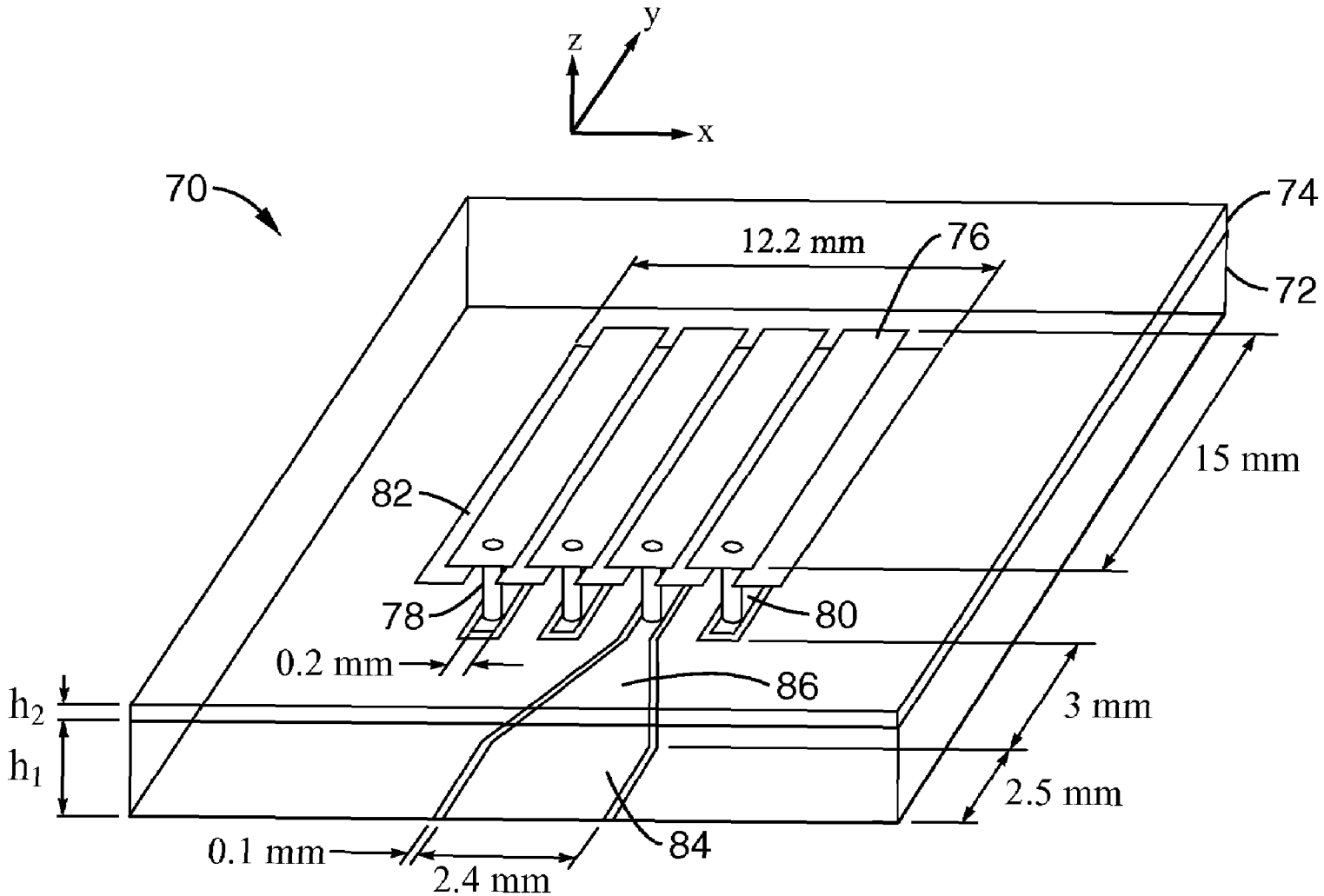
FIG. 10 is a perspective view of a small one dimensional CRLH resonant antenna cell according to an aspect of the present invention, showing a mushroom configuration.
Figure 11B:
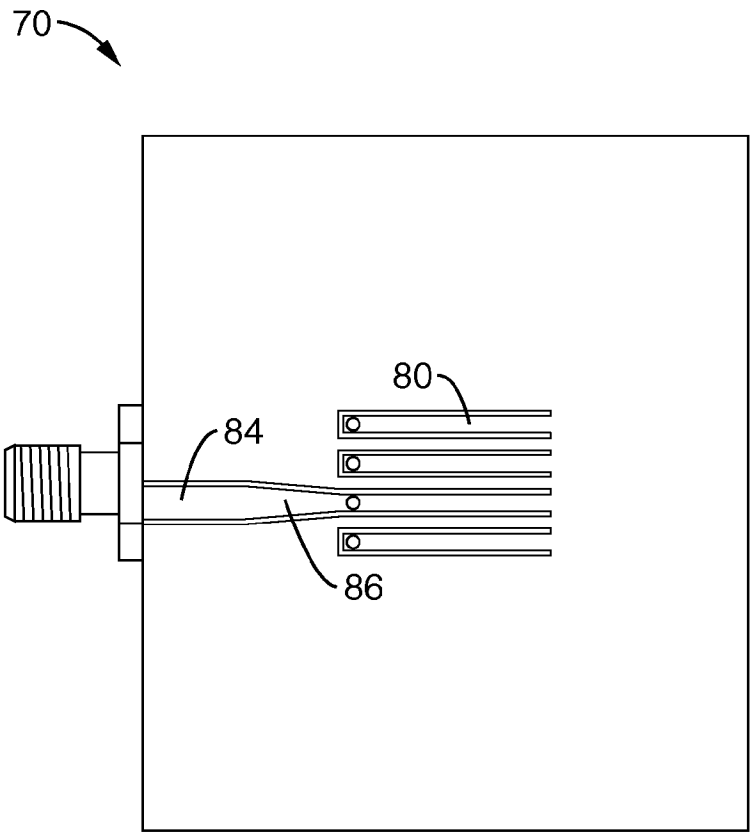
FIG. 11A-11B are front and back views of the CRLH-TL antenna shown in FIG. 10.
Figure 11A:
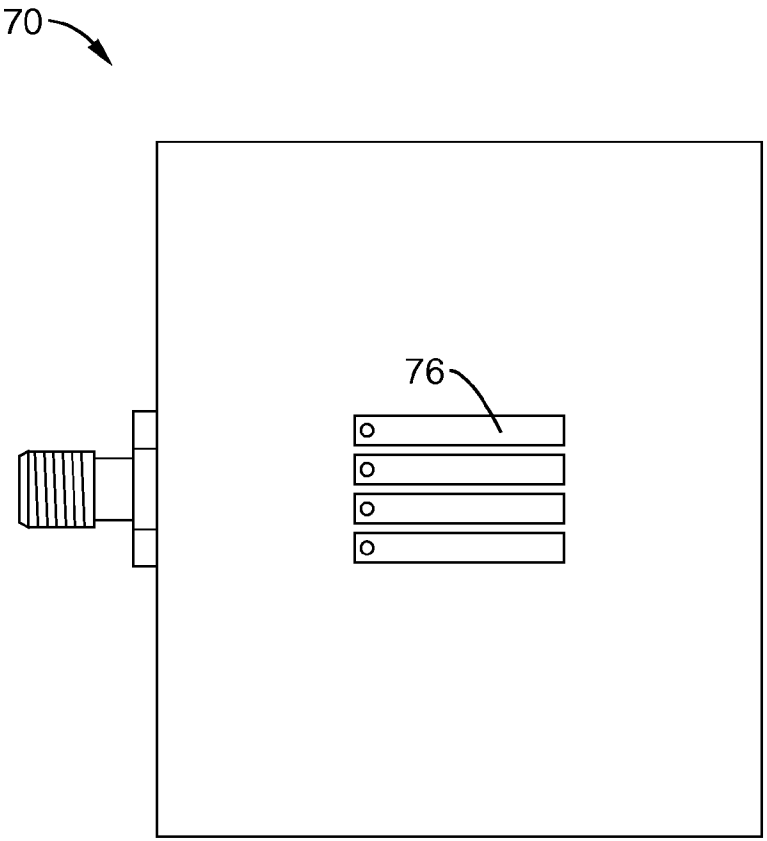

FIG. 10 illustrates an example embodiment 70 of a small one dimensional array resonant antenna with FIG. 11A and 11B showing the top view and back view of the fabricated circuit, respectively. A first dielectric layer 72 is shown beneath a second dielectric layer 74. A first plurality of conductive strips 76 (four are shown) are disposed over the second dielectric 74, and coupled through vias 78 with CPW stubs 80 within a ground plane disposed on the underside of first dielectric layer 72. A second plurality of conductive strips 82 (five are shown) are disposed between the first and second dielectric layers to form MIM capacitors. It should be noted that the number of strips in the second plurality of conductive strips is one more per axis than required for the number of first conductive strips, wherein each of the first plurality of conductive strips is preferably subject to the same capacitance. The number of unit cells for the antenna is determined by the number of strips contained in the first plurality of conducive strips. The same four unit cell structure shown in FIG. 6 is used and a CPW feeding network is designed to excite n=−1 mode.

A 50Ω CPW feeding line 84 and a section of CPW tapered line 86 are shown connected to the second via of the unit cell to properly match the antenna input impedance to 50Ω and excite the antenna. Aside from impedance matching purposes, the use of CPW line as the feeding network can also enable the antenna to be easily integrated with active devices. The physical length, width and height of the small antenna shown in FIG. 10 are 12.2 mm, 15 mm and 3.414 mm, and are 1/19λ, 1/23 λ and 1/88λ in terms of free space wavelength. This implementation achieves a 98% foot print area reduction in comparison to a conventional patch antenna built on a substrate with dielectric constant 2.2. A thickness for the implementation taught herein of 3.414 mm can be obtained.

Figure 12:
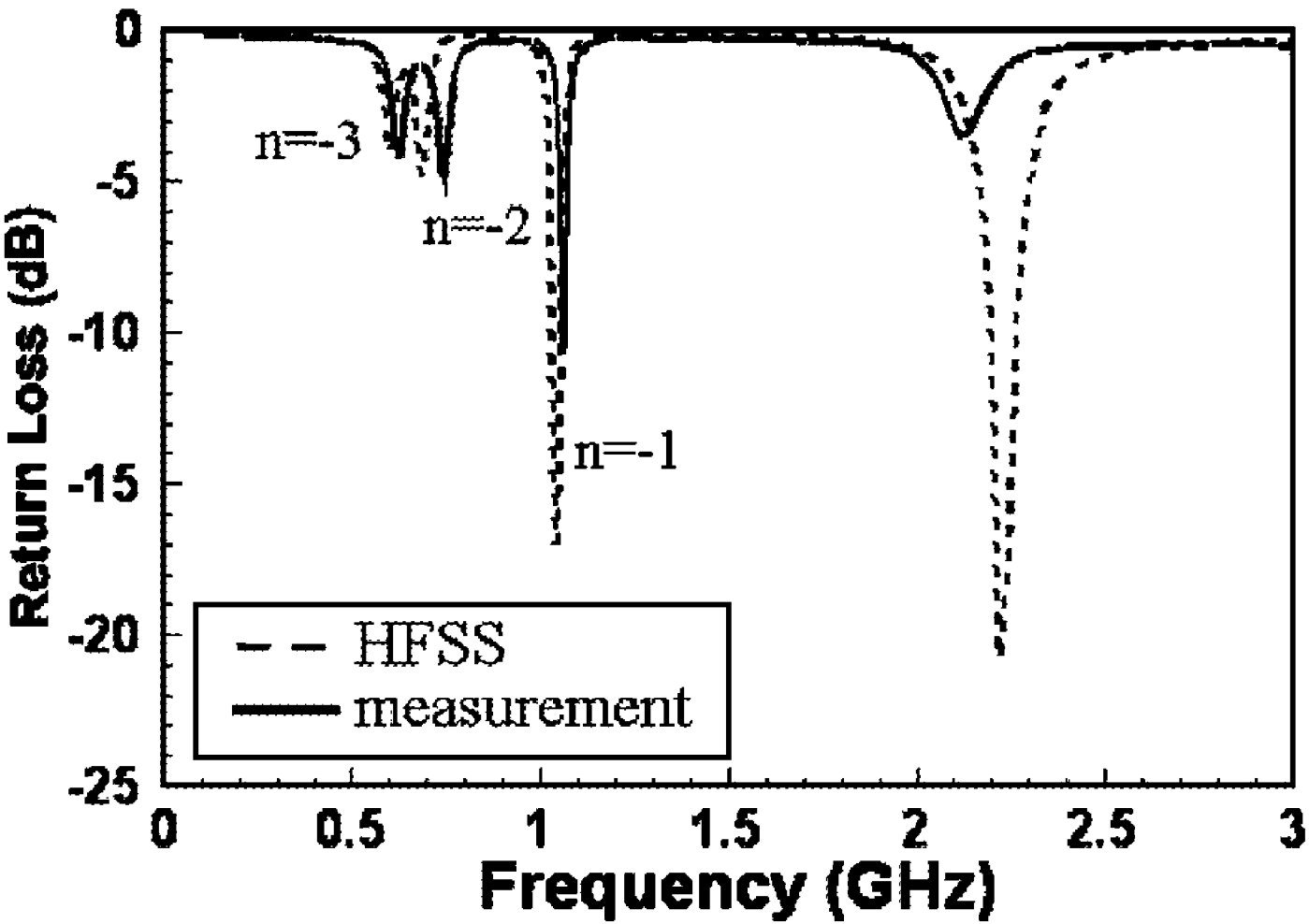
FIG. 12 is a graph of return loss for the one-dimensional array CRLH antenna of FIG. 10.

FIG. 12 illustrates a plot of observed return loss for the antenna, indicating that the n=−1 at 1.06 GHz is excited. Under this feeding approach and unit cell design, n=0 mode is not excited and n=−2 and n=−3 mode at 0.74 GHz and 0.62 GHz are weakly excited. The deviation of those frequencies compared to the resonator measurement mentioned in the previous description can be attributed to the extra capacitance and inductance contributed by the feeding network. Return losses were obtained for the three modes, n=−1, n=−2 and n=−3, as −10.5 dB, −4.9 dB and −4.2 dB respectively. The HFSS simulation result agrees well with the experimental data except for the magnitude difference at 2.2 GHz. The occurrence of the dip at this unexpected frequency may be due to unintentional impedance matching.

Figure 14:
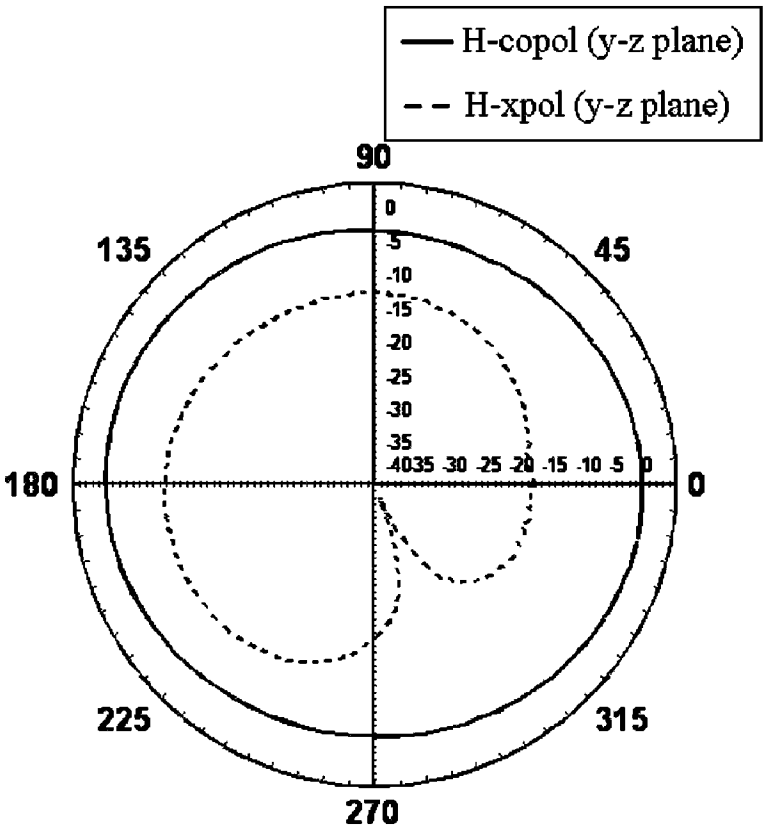
FIG. 13-14 are graphs of radiation patterns for the CRLH antenna of FIG. 10, showing E-plane and H-plane radiation patterns.
Figure 13:
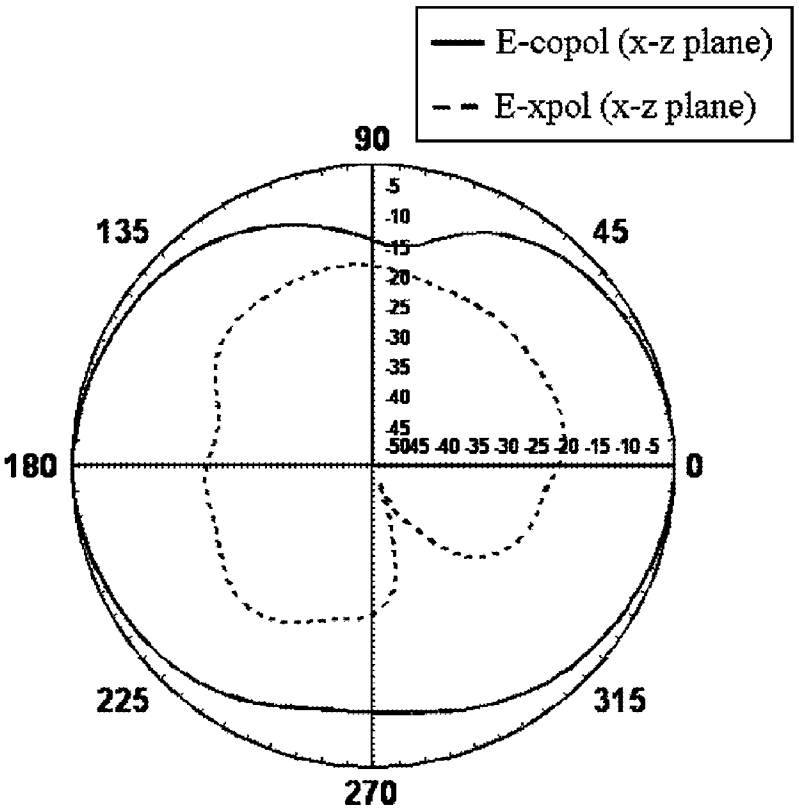

FIG. 13-14 illustrate measured radiation patterns for the antenna design of FIG. 10. Even though lower resonances occur, the n=−1 mode is of most interest in the design of the antenna prototype. The normalized radiation patterns of the antenna at 1.06 GHz for the n=−1 mode are displayed in FIG. 13-14. In both E-plane (x-z plane) and H-plane (y-z plane), power radiates from both the broadside and backside of the antenna. The backside radiation is contributed by the slot of the CPW stub and small ground plane.

The antenna gain of −13 dBi for n=−1 mode is measured and the cross polarization of −18 dB at broadside direction is observed. As for n=−2 mode and n=−3 mode, the measured antenna gain are both less than −20 dBi.

The theoretical gain limitation can be approximated by:

$$\text{Gain}=(ka)^2+2(ka) \tag{6}$$

where k is the free space propagation constant and a is the radius of sphere enclosing the maximum dimension of the antenna. Therefore, the low antenna gains are expected because of the small antenna size. In addition, the radiation efficiency was measured by total radiation power over the input power, which is defined as follows:

$$\eta_{ESA} = \frac{\text{radiation power}}{\text{radiation power} + \text{power loss}} = \frac{R_{\text{rad}}}{R_{\text{rad}} + R_{loss}} \tag{7}$$

where power loss can be due to conductor loss or dielectric loss. The measured efficiency including the impedance mismatch of the n=−1 mode is around 2% and n=−2, n=−3 mode are less than 1%. The low radiation efficiency implies the radiation power is much less than the power loss in the antenna. In this case, a large current concentrates at the vias which are lossy conductors. As a result, the large loss in the structure is generated, thus reducing antenna efficiency.

It is to be appreciated that the three antennas mentioned above were built using University of California at Los Angeles (UCLA) limited manufacturing capabilities, wherein further improvements have been shown found when utilizing more precise techniques.

4. Gain Improvement for CRLH-TL Based Small Antenna.

Besides the small size, non-uniform excitation mechanisms may degrade the aperture efficiency, thus reducing the antenna gain and radiation efficiency. Therefore, another type of small antenna with higher gain and radiation efficiency is presented in this section to better fulfill the strict requirement of modern commercial applications.

Figure 15:
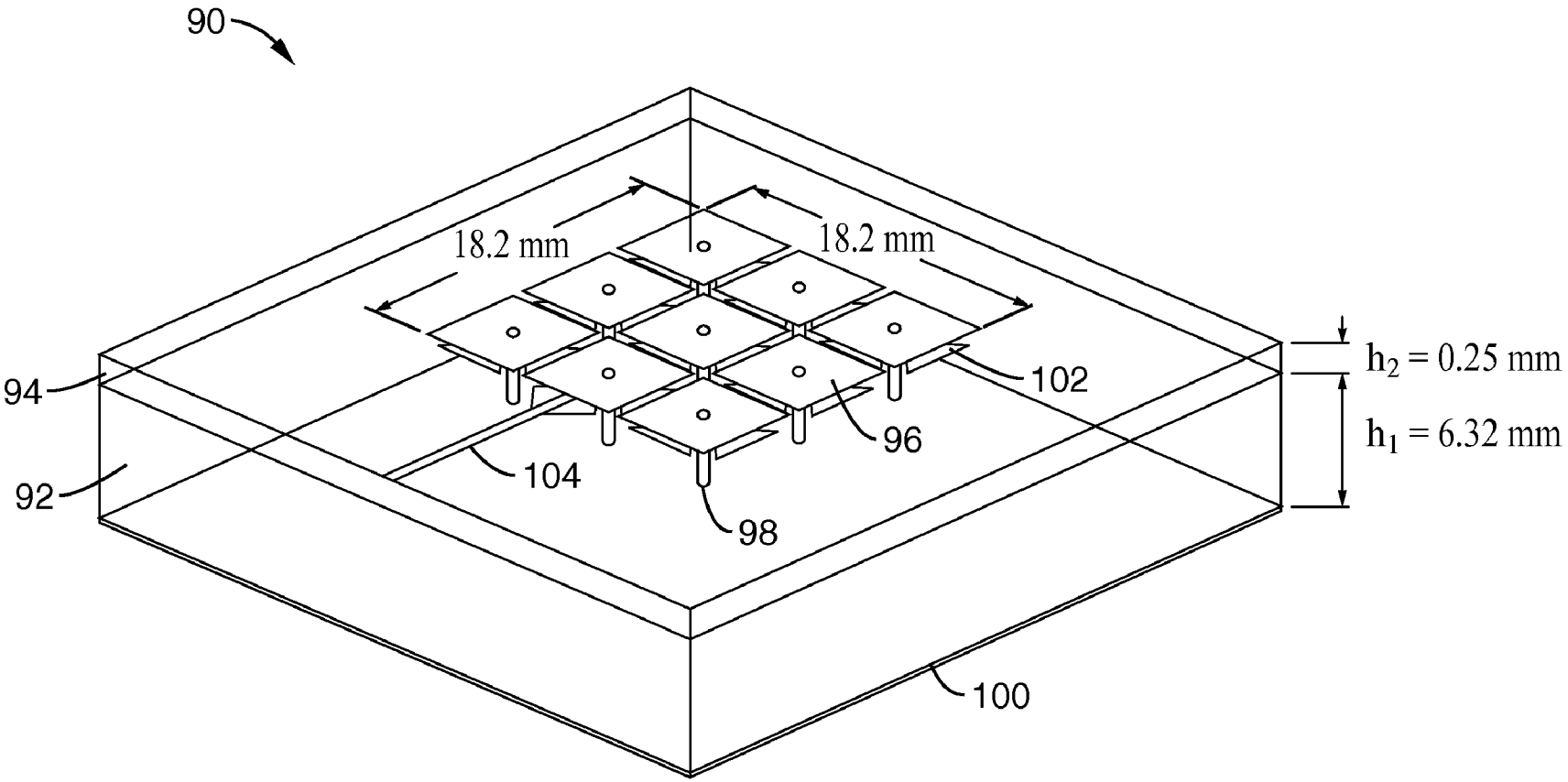
FIG. 15 is a perspective view of a gain-improved two-dimensional CRLH-TL resonant antenna according to an aspect of the present invention, showing a three-by-three cell mushroom structure CRLH implementation.

FIG. 15 illustrates an embodiment 90 of a CRLH-TL gain-improved antenna design which has a similar mushroom-like structure for the unit cell, but is configured in a two-dimensional array. The figure depicts the configuration of the antenna, which by way of example and not limitation, is shown having two substrates comprising a first substrate 92 and a second substrate 94 which provide vertical separation of three metal layers. Again, a thicker substrate 92 with low dielectric constant (e.g., $\epsilon_{r1}$=2.2, $h_1$=6.32 mm) and a thinner substrate 94 with high dielectric constant (e.g., $\epsilon_{r2}$=10.2, $h_2$=0.254 mm) are stacked together.

It should be appreciated that the term dielectric constant is equivalent to relative permittivity. Permittivity being the measure of the influence of the electric displacement field on the organization of electrical charges in a given medium, including the influence of charge migration and electric dipole reorientation. Relative permittivity is the ratio of permittivity in relation to the permittivity of free space. It will be noted that permittivity for a material varies with respect to frequency.

Each unit cell of this example embodiment includes a first plurality of conductive elements 96, shown comprising a 6 mm by 6 mm square patch with 0.2 mm gap between the adjacent patches on top. Metallic vias 98 connect between each conductive element 96 and a ground plane 100. A solid ground plane is depicted, however, it should be appreciated that alternative ground plane configurations can be adopted, such as with or without CPW stubs and those configured as solids or meshes and other known configurations, although these changes lead to altered operational characteristics.

A plurality of MIM capacitors are integrated within the antenna, shown as a second plurality of conductive elements 102, such as having a size of 2.7 mm by 2.7 mm, linked to adjacent cells in both x and y directions. The MIM capacitor and a long via, as mentioned in the previous section, can maximally increase the series capacitance and shunt inductance. A single feedline 104 is shown coupled to one of the conductive elements within the first plurality of conductive elements. The elimination of the CPW stub and the reduction of the overlapping area of the parallel microstrip will decrease the series capacitor and shunt inductor to 2.49 pF and 4.9 nH, respectively in this case. Therefore, the operational frequency is expected to be higher than the previous design.

Figure 16:
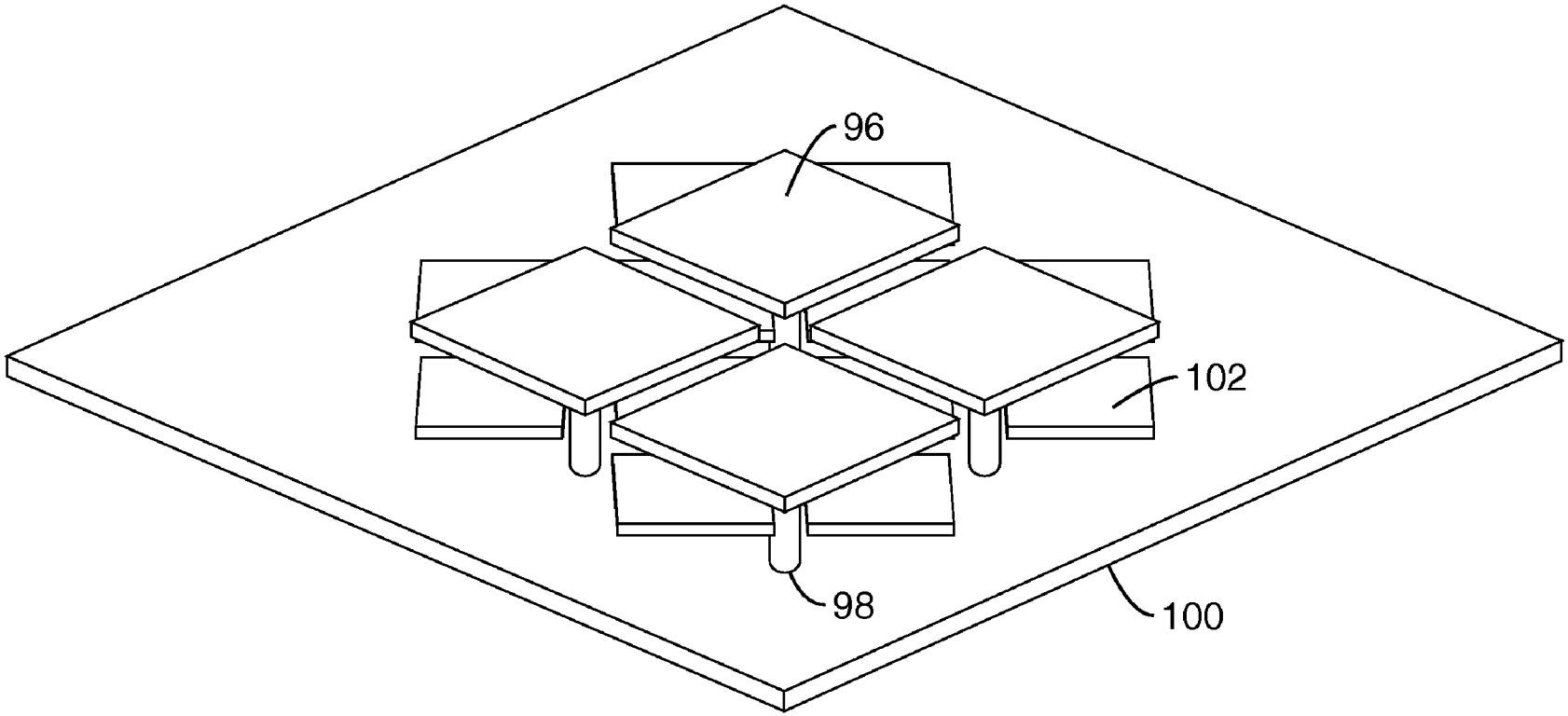
FIG. 16 is a perspective view of a gain-improved two-dimensional CRLH-TL resonant antenna according to an aspect of the present invention, showing a two-by-two cell mushroom structure CRLH implementation.

FIG. 16 illustrates a two-by-two array of cells without the first and second dielectric layers, which can represent in a detailed view a portion of the cells shown in FIG. 15. It should be appreciated that FIG. 16 can also represent the use of a smaller sized array embodiment, wherein the apparatus can be generally implemented with a one or two dimensional array of any desired number of cells.

In order increase gain a larger aperture is used in this antenna design by arranging the unit cells in a two-dimensional (2-D) matrix configuration. As a result, this structure can be excited more uniformly than the (1-D) prototype discussed in the previous section. The resonant frequencies of the structure were first determined from full-wave simulation. Table 1 shows the simulation results of five different resonators. By way of example and not limitation, each resonator in this example is three cells long, but varies in width from one cell to five cells. The results indicate that all the cases have similar resonant frequencies around 1.18 GHz and 0.88 GHz corresponding to the n=−1 and the n=−2 mode. This suggests that multiple row arrangements with three unit cells in the resonant direction have the same propagation characteristics as the single one-dimensional (1-D) unit cell arrangement and can be viewed as a 1-D homogenous transmission line. Therefore, the antenna aperture can be changed in the non-resonant direction without affecting antenna operational frequency.

An antenna prototype using the three-by-three configuration, as shown in FIG. 15 was fabricated and tested. According to the invention, it is expected that this configuration will provide larger aperture size, thus increasing antenna gain. In addition, this structure allows for an input impedance of 50Ω to be realized with less tuning than the other prototypes. For this given implementation a microstrip line is fed at the edge of the antenna with a small gap of 0.1 mm, and the width and length of the microstrip line is optimized as 0.4 mm and 6.0 mm, respectively, to match the antenna to 50Ω at center frequency. The physical size of this antenna is 18.4 mm by 18.4 mm by 6.574 mm or 1/14λ by 1/14λ by 1/39λ in terms of free space wavelength.

Figure 17:
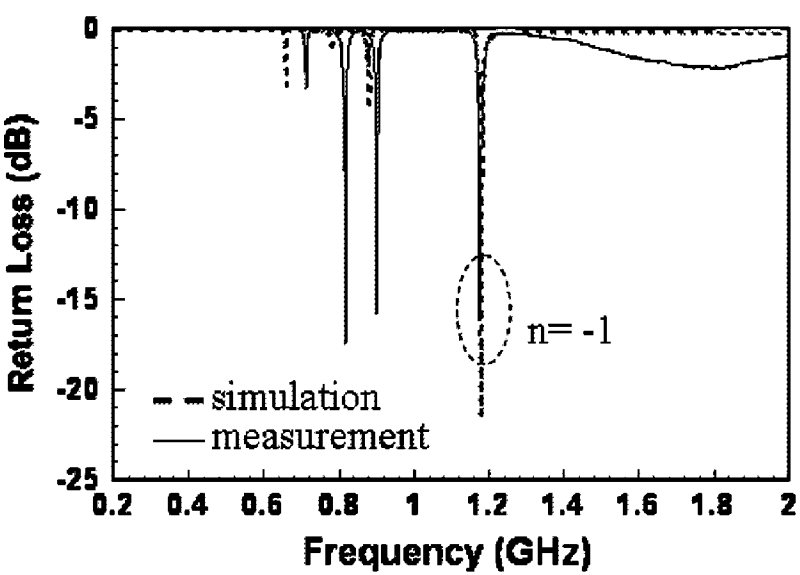
FIG. 17 is a graph of return loss of the gain-improved antenna of FIG. 15.

FIG. 17 illustrates return loss for the antenna of FIG. 15 operating at n=−1 mode which corresponds to 1.17 GHz with return loss of −16 dB. The bandwidth of |S11|<−10 dB is approximately 0.4%. Other three peaks occurring at lower frequencies in FIG. 17 may be attributed to the higher order modes and the coupling between the unit cells in the direction orthogonal to the microstrip feeding line.

Figure 18:
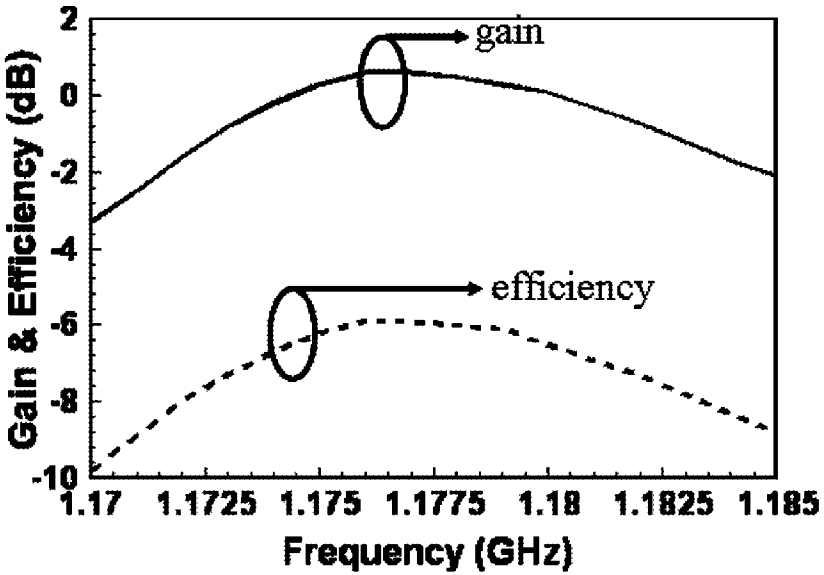
FIG. 18 is a graph of antenna gain and radiation efficiency with respect to frequency for the CRLH antenna of FIG. 15.

FIG. 18 illustrates measured antenna gain and efficiency with respect to frequency for the antenna of FIG. 15. After measuring the total radiation power and the input power excluding the reflected power, the antenna radiation efficiency is calculated and plotted from 1.17 GHz to 1.185 GHz in FIG. 18. The maximum antenna radiation efficiency of 26% (−5.9dB) at 1.176 GHz was obtained. At the same frequency, the maximum antenna gain of 0.6 dBi at the broadside direction was also measured. These results demonstrate a dramatic performance improvement compared to the small antenna prototype exemplified in FIG. 10 even though this antenna is only slightly larger.

Figure 20:
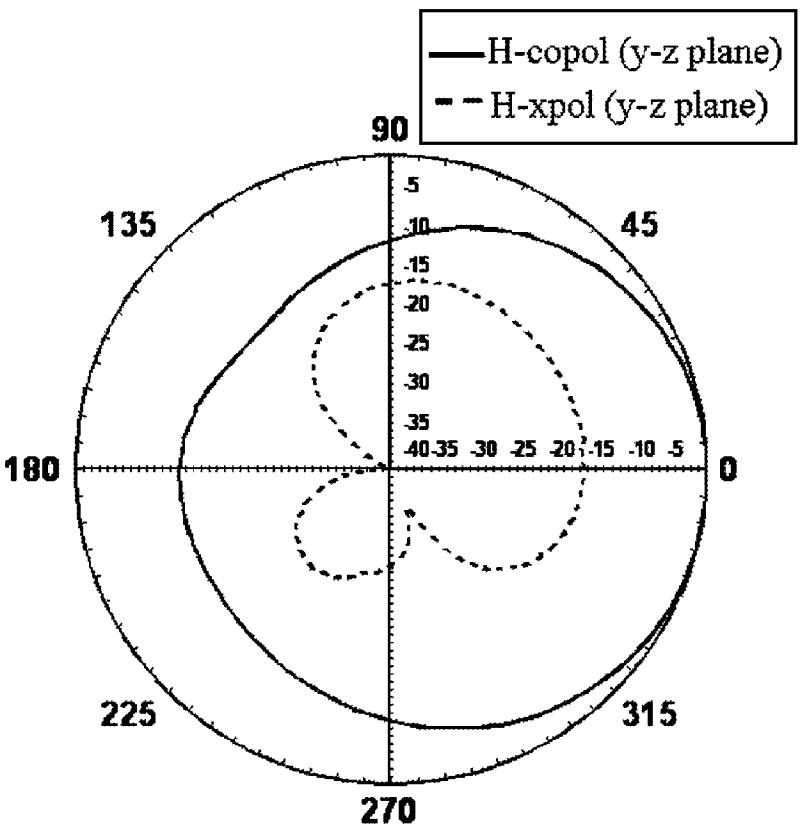
FIG. 19-20 is a graph of radiation patterns at the E-plane and H-plane, respectively, for the CRLH-TL antenna of FIG. 15.
Figure 19:
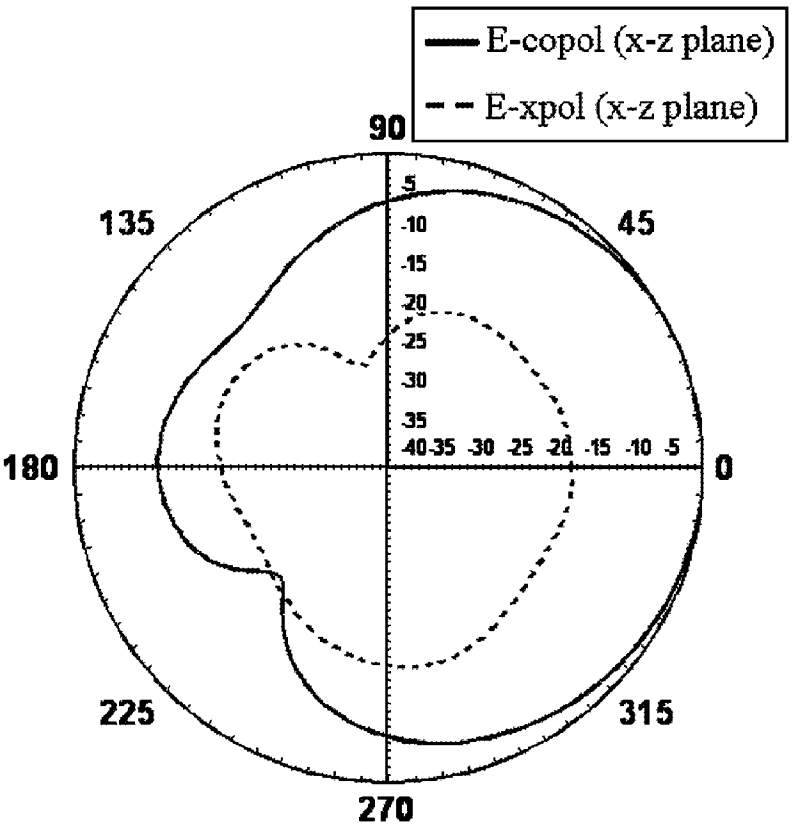

FIG. 19 shows the radiation pattern with far field characteristics of E-plane (y-z plane) while FIG. 20 shows the H-plane (x-z plane) for the example design of FIG. 15. For the normalized radiation pattern in the E-plane, the front-to-back ratio is 11 dB and the cross polarization at broadside is 17 dB. As for the H-plane, the normalized radiation pattern shows 13 dB front-to-back ratio and 20 dB cross polarization can be observed.

5. Design of Small Circularly Polarized Antenna.

The circularly polarized antenna is an important class of radiators in microwave and millimeter-wave applications because of its flexible alignment between the transmitting and receiving antennas. Often, such antennas are applied to Global Position System (GPS), satellite, and terrestrial communication. Several simple methods of inducing circular polarization are available including dual-feed with quadrature phase difference and single-feed utilizing an asymmetric resonant cavity. To simplify the design complexity, the more direct approach comprising a dual-feed with phase delay circuit is described in this section.

Figure 21:
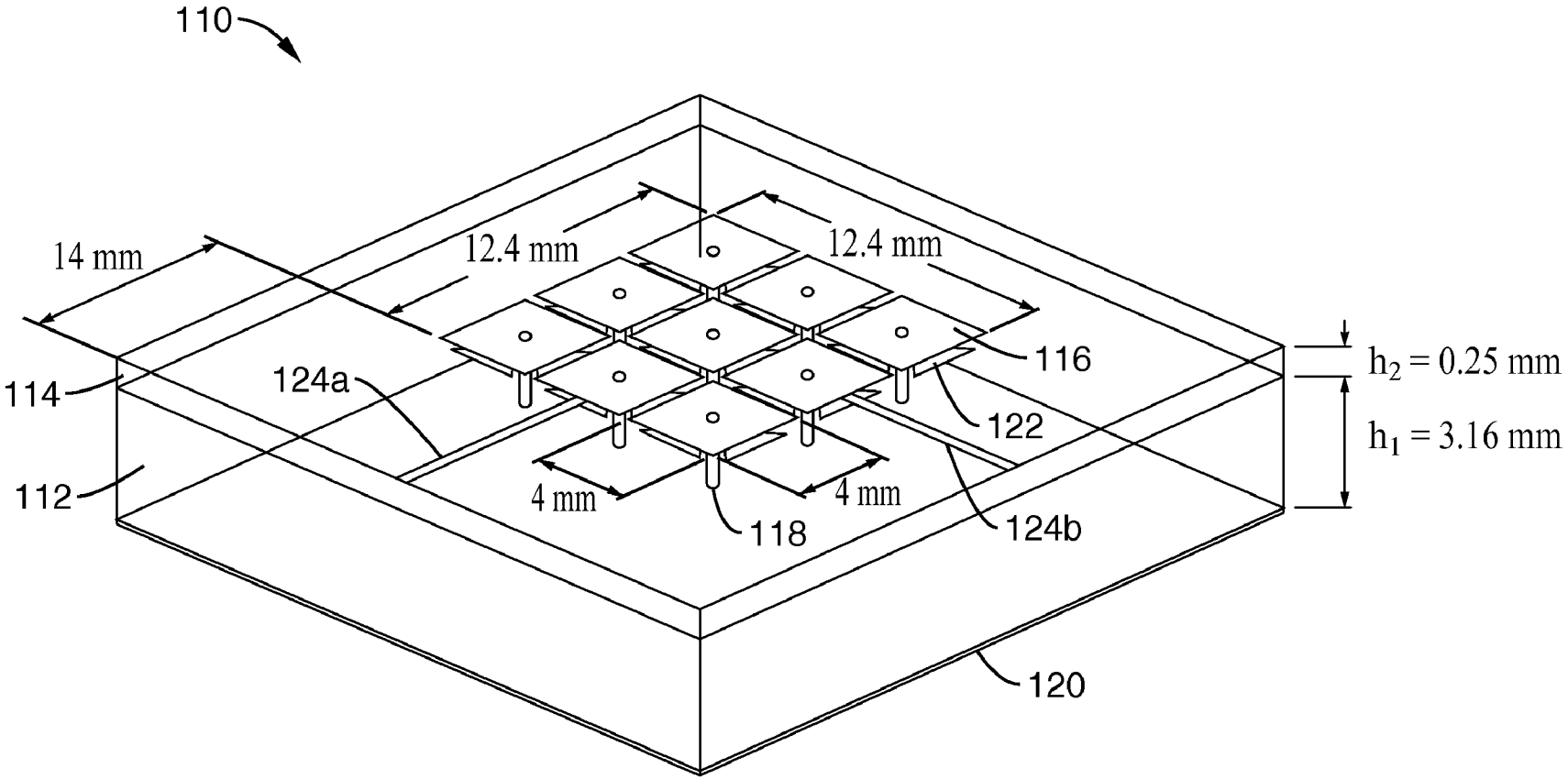
FIG. 21-22 is a perspective view of a two-dimensional circularly polarized antenna according to an aspect of the present invention, showing full view in FIG. 21 and a construction detail in FIG. 22.
Figure 22:
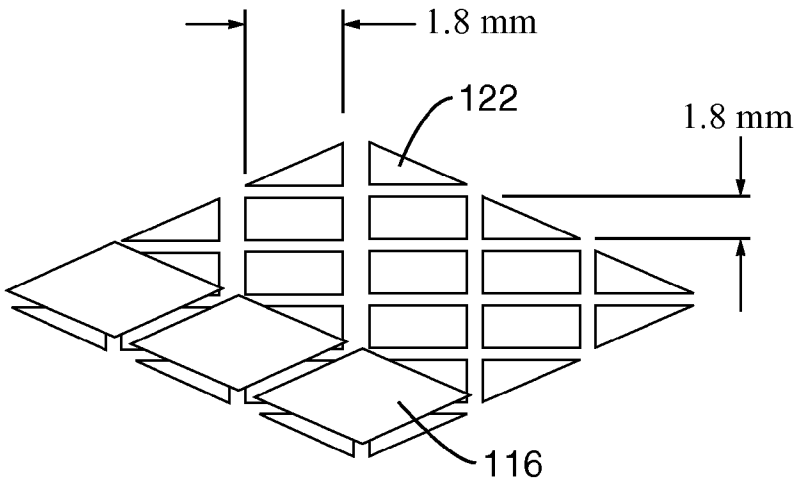

FIG. 21-22 illustrates an example embodiment 110 of a dual-feed circularly polarized antenna, with FIG. 21 depicting overall structure and FIG. 22 illustrating construction details. This design basically duplicates the small antenna described in FIG. 10, but scales down the size of the unit cell to operate at 2.4 GHz and utilizes dual-feed with an additional microstrip feeding line attached at the orthogonal antenna edge to provide dual-feeding. FIG. 21 depicts a first substrate 112 and a second substrate 114. A first plurality of conductive elements 116 is shown with metallic vias 118 connecting between each separate conductive element 116 and a ground plane 120. A plurality of MIM capacitors are integrated within the antenna, shown as a second plurality of conductive elements 122. A first and second port are shown 124*a*, 124*b* for introducing the signal to antenna 110. FIG. 22 depicts first 116 and second 122 conductive regions of FIG. 21, shown with some of the first conductive regions removed to illustrate the spacing of a portion of the second conductive regions.

Figure 23:
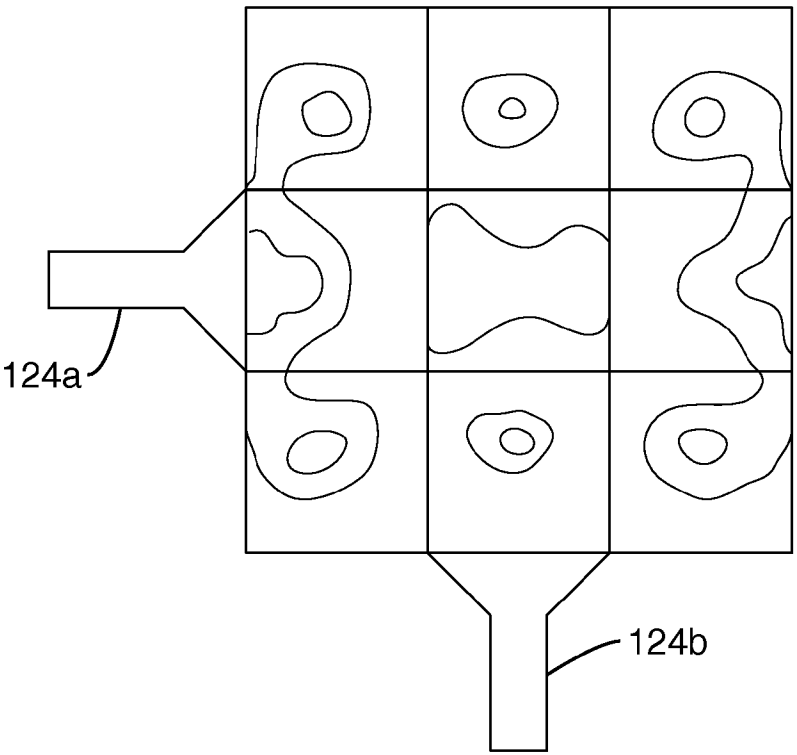
FIG. 23 is a field distribution map of field distribution over the two-dimensional circularly polarized antenna of FIG. 21.

FIG. 23 depicts the field distribution on the prototype antenna, showing that the minimum and maximum field occurs at the middle and the edge of the antenna, respectively. First, this implies that the interaction between the two input ports is weak, and second that the antenna operates at half-wavelength resonance. The physical size of this implementation of the antenna is 12.4 mm by 12.4 mm by 3.414 mm and is 1/10λ by 1/10λ by 1/36λ in terms of free space wavelength.

Figure 24:
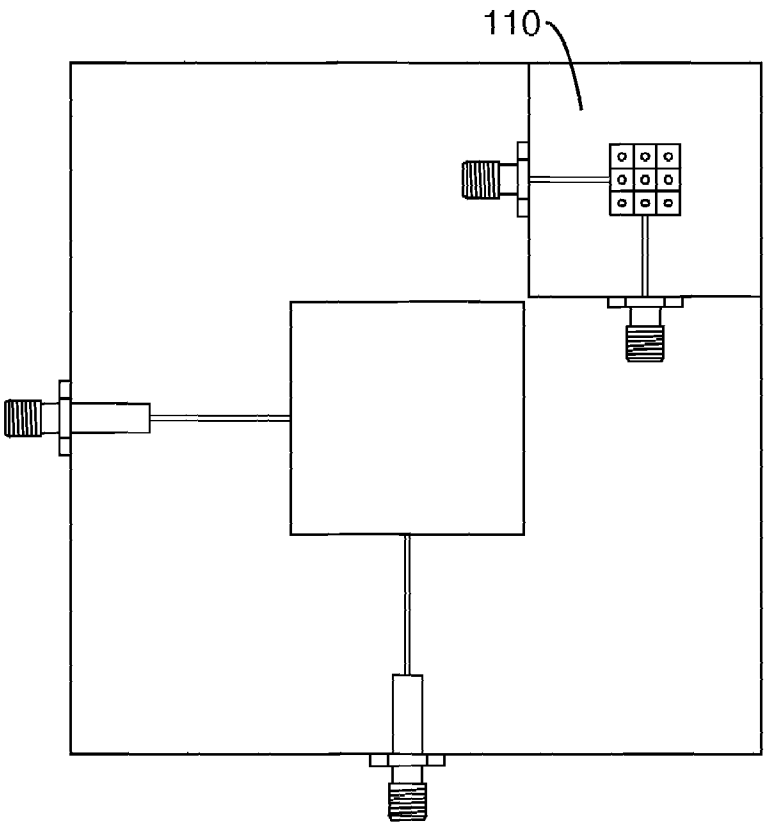
FIG. 24 is a top view size comparison between the CRLH-TL antenna of FIG. 21 (foreground) and a conventional patch antenna (background).

FIG. 24 illustrates a comparison of the inventive antenna 110 and the conventional circularly polarized patch (beneath antenna 110). The comparison shows that a 90% foot print area reduction can be readily obtained according to the present invention.

Figure 25:
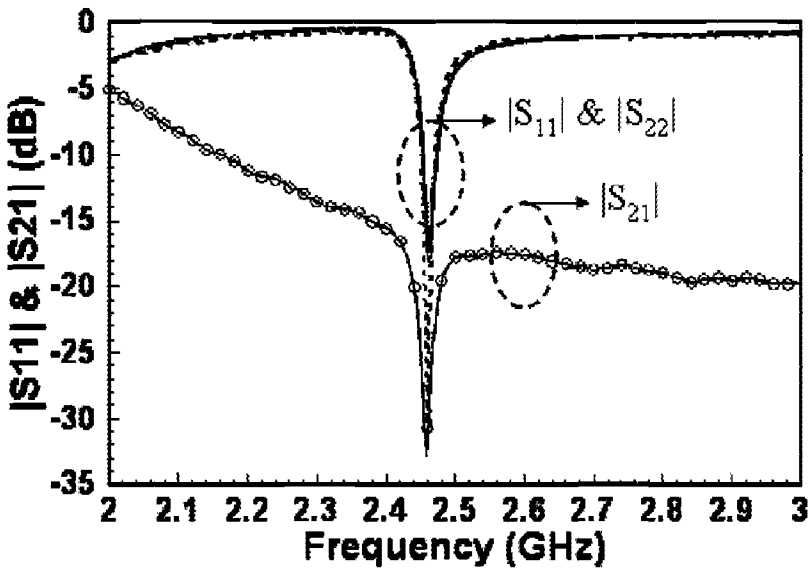
FIG. 25 is a graph of measured S-parameters of the circularly polarized antenna of FIG. 21 according to an aspect of the present invention.

FIG. 25 illustrates a plot of the measured S-parameters of the antenna of FIG. 21-22. The return losses corresponding to two input ports are −31 dB and −17 dB at 2.46 GHz. The insertion loss at the same frequency verifies that the coupling between two input ports is less than −30 dB, which leads to improved excitation of the two orthogonal modes.

Figure 26:
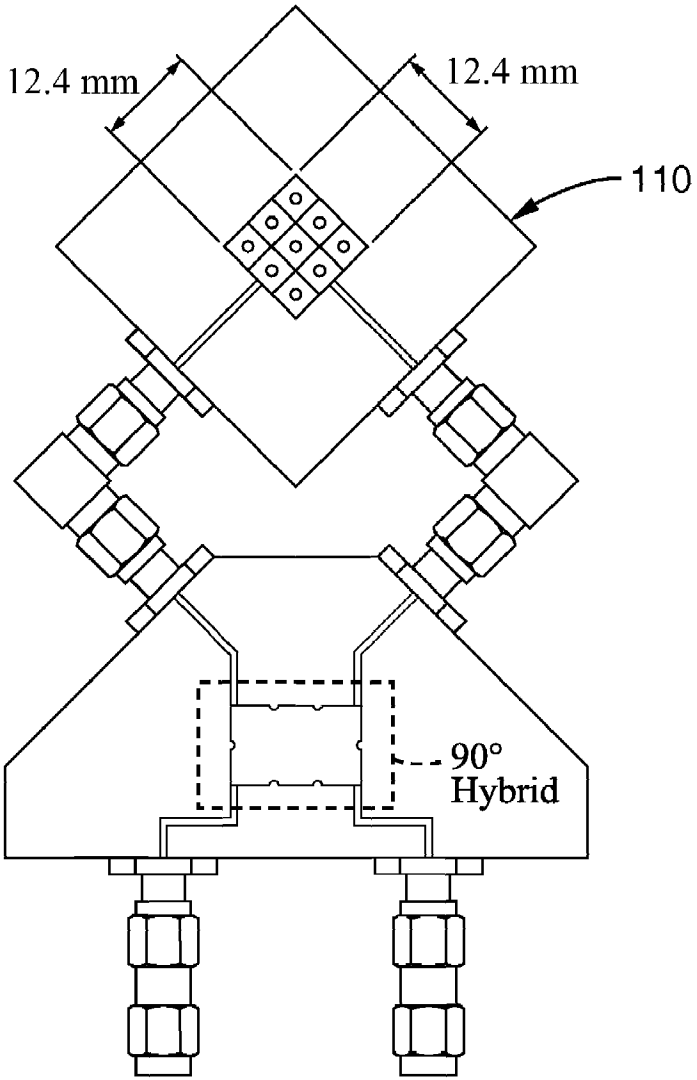
FIG. 26 is a top view of the two-dimensional circularly polarized antenna of FIG. 21, shown assembled with a chip hybrid according to an aspect of the present invention.

FIG. 26 illustrates an example of an assembled circularly polarized antenna 110 connected to a chip hybrid coupler. The hybrid coupler generates the required 90° phase difference between the two input ports of the antenna, thus achieving circular polarization.

Figure 27:
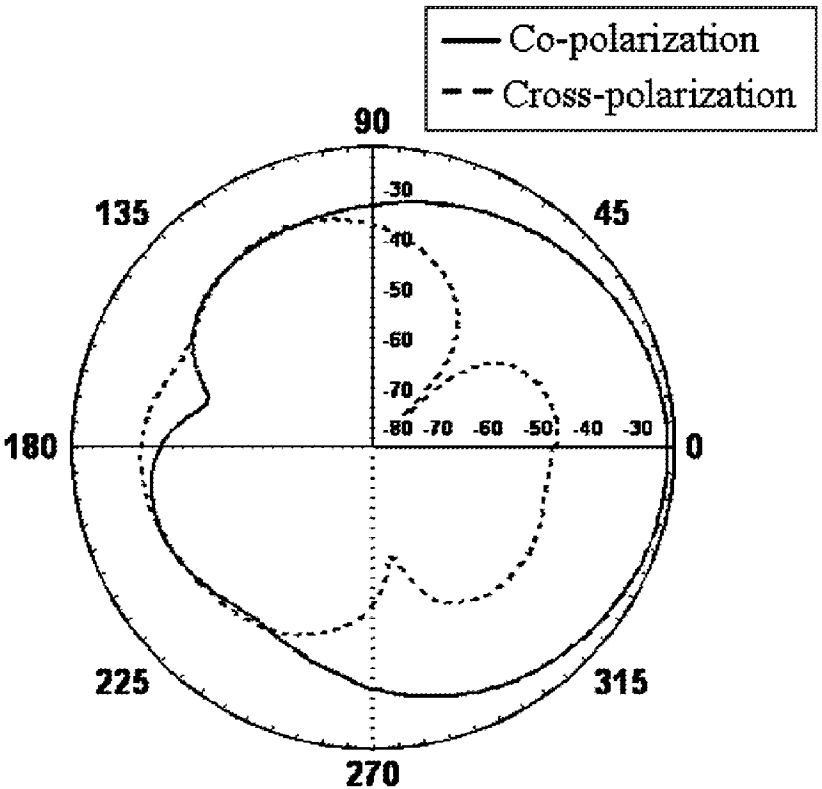
FIG. 27 is a graph of the radiation pattern for the antenna of FIG. 21.

FIG. 27 illustrates the measured radiation pattern of the circularly polarized antenna. The maximum antenna gain is 2.17 dBi at the center frequency and the cross polarization is approximately 23 dB at broadside.

Figure 28:
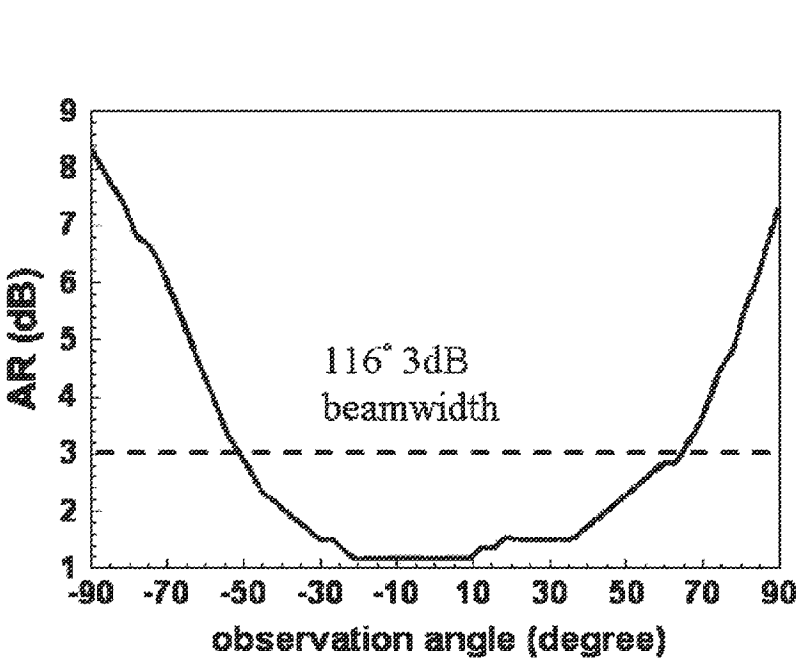
FIG. 28 is a graph of the axial ratio for the antenna of FIG. 21.

FIG. 28 illustrates the axial ratio measured at different observation angles for the antenna. At the broadside direction, a minimum axial ratio of 1.2 dB can be observed. It will be noted that as the observation angle increases, the axial ratio degrades. The 3 dB axial ratio beamwidth of 116° is calculated from the figure.

6. Conclusion.

A novel approach for the realization of compact antennas has been described which is particularly well-suited in the range of frequencies between approximately hundreds of MHz and tens of GHz. The antenna designs are based on the unique fundamental left-handed mode propagation properties of the CRLH-TL. At frequencies near the low cutoff-frequency the propagation constant approaches infinity, therefore using the CRLH-TL in this region an electrically large, small sized antenna can be realized depending on the unit cell optimization and miniaturization.

Using this design approach a four unit cells $\lambda_g/2$ resonant antenna is designed and tested at 1.06 GHz. Even though the antenna consists of a number of patches used as unit cells, the difference between this antenna and a stacked patch antenna is that the size of each unit cell in the antenna can be made significantly smaller than that within the guided wavelength antenna. The cascaded unit cells are used to provide the resonant length of half-wavelength field distribution at 1.06 GHz. The dimensions of this particular antenna prototype implementation are 1/19λ, 1/23λ and 1/83λ.

A second antenna prototype was developed using a 2-D unit cell arrangement, specifically the implementation had a three-by-three array of unit cells. This geometry change led to an improved maximum gain and higher radiation efficiency, with only a slight increase in size. The dimensions of this prototype are 1/14λ by 1/14λ by 1/39λ. Even though the fractional bandwidth and radiation efficiency are less than antennas which are currently assembled in commercial products, the size reduction of the antenna still demonstrate the potential of applying these antennas to wireless communication systems. Furthermore, a circularly polarized antenna based on CRLH-TL operating at 2.46 GHz was developed with a physical size of 1/10λ by 1/10λ by 1/36λ with a 116° 3 dB axial ratio beamwidth.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

TABLE 1

Simulation Results for Resonant Frequencies of Different Resonators

| Structure | mode n = −1 (GHz) | mode n = −2 (GHz) |
|---|---|---|
| 3 × 1 | 1.22 | 0.90 |
| 3 × 2 | 1.20 | 0.88 |
| 3 × 3 | 1.18 | 0.88 |
| 3 × 4 | 1.16 | 0.88 |
| 3 × 5 | 1.16 | 0.88 |

What is claimed is:

1. An apparatus for transmitting or radiating radio frequencies within a composite right/left-handed (CRLH) transmission line, comprising:

at least one dielectric layer;

a first conducting element over said at least one dielectric layer;

a ground plane under said at least one dielectric layer;

a vertical conductor extending through said at least one dielectric layer to connect said first conducting element to said ground plane; and means for guiding a signal along at least one waveguide within said ground plane and up through said vertical conductor passing through said at least one dielectric layer to said first conducting element, wherein said CRLH based apparatus is configured using equivalent circuit models that comprises Right-Hand (RH) series induction ($L_R$) and shunt capacitor ($C_R$), and Left-Hand (LH) series capacitor ($C_L$) and induction ($L_L$); and wherein the effective permittivity (e) and permeability (m) of the structure are manipulated by the choice of $C_R$, $L_R$, $C_L$, and $L_L$.

2. An apparatus as recited in claim 1, wherein said apparatus comprises an antenna when said signal is radiated from said apparatus, or a transmission line when said signal is transmitted through said apparatus.

3. An apparatus as recited in claim 1, further comprising a coplanar wavelength (CPW) stub within said ground plane at a connection to said vertical conductor.

4. An apparatus as recited in claim 1, further comprising:

a first dielectric layer, of a first thickness and having a first dielectric constant, within said at least one dielectric layer;

a second dielectric layer, of a second thickness and having a second dielectric constant, within said at least one dielectric layer;

said second dielectric layer positioned over said first dielectric layer;

wherein said first conducting element is positioned over said second dielectric layer, and said vertical conductor passes through both said first and second dielectric layer;

at least a second conductive element retained between said first and said second dielectric layers;

a metal-insulator-metal (MIM) capacitor formed in response to the proximal relation of said second conductive element in relation to said first conductive element; and wherein said MIM capacitor is configured to lower the resonant frequency of said apparatus.

5. An apparatus as recited in claim 3, wherein said second dielectric constant is higher than said first dielectric constant.

6. An apparatus as recited in claim 3, wherein said second thickness is less than said first thickness.

7. An apparatus as recited in claim 1, wherein a plurality of first conducting elements and vertical conductors within said apparatus are arranged in a one or two dimensional array coupled to said means for guiding a signal.

8. An apparatus for transmitting or radiating radio frequencies within a composite right/left-handed (CRLH) transmission line, comprising:

a first dielectric layer forming a structure substrate;

second dielectric layer positioned over said first dielectric layer;

a ground plane disposed under said first dielectric layer;

a first plurality of conductive elements disposed over said second dielectric layer;

a second plurality of conductive elements disposed between said first and second dielectric layers and positioned to form metal-insulator-metal (MIM) capacitors in response to proximity with said first plurality of conductive elements, said capacitors lower the resonant frequency of said apparatus;

a plurality of vias interconnecting said first plurality of conductive elements with said ground conducting layer; and at least one feed line attached to said first plurality of conductive elements;

wherein said CRLH based apparatus is configured using equivalent circuit models that comprises Right-Hand (RH) series induction ($L_R$) and shunt capacitor ($C_R$), and Left-Hand (LH) series capacitor ($C_L$) and induction ($L_L$); and wherein the effective permittivity (e) and permeability (m) of the structure are manipulated by the choice of $C_R$, $L_R$, $C_L$, and $L_L$.

9. An apparatus as recited in claim 8:

wherein said first dielectric layer comprises a material having a first dielectric constant and a first thickness;

wherein said second dielectric layer comprises a material having a second dielectric constant and a second thickness;

wherein said second dielectric constant is higher than said first dielectric constant;

wherein said second dielectric thickness is less than said first dielectric thickness.

10. An apparatus as recited in claim 8, wherein said conductive elements comprise conductive plates or conductive strips.

11. An apparatus as recited in claim 8, wherein the frequency of said CRLH apparatus is in the range of frequencies between approximately hundreds of MHz and tens of GHz.

12. An apparatus as recited in claim 8:

wherein said vias are connected between each said conductive element in said first plurality of conductive elements, and said ground plane; and wherein said vias are connected to each said conductive element either at the center of said conductive element as a symmetrical connection, or off of the center of said conductive element as non-symmetrical connection.

13. An apparatus as recited in claim 8, wherein said first plurality of conductive elements are positioned in a one-dimensional array of N number of cells.

14. An apparatus as recited in claim 13, herein said array has four cells.

15. An apparatus as recited in claim 13, wherein said array has a size of approximately a $1/19\lambda \times 1/23\lambda \times 1/83\lambda$.

16. An apparatus as recited in claim 13, wherein said N number of cells are cascaded in series in response to which the CRLH structure resonates at 2N+1 resonance, which is a mode of resonance.

17. An apparatus as recited in claim 13:

wherein n=0 is the zeroeth order mode, n=+1, +2 . . . , +(N−1) are the RH resonance modes;

wherein e and m>0, and n=−1, −2, . . . , −(N−1) are the LH modes; and wherein e and m<0, and where n is an integer multiple, e is effective permittivity and m is permeability.

18. An apparatus as recited in claim 8:

wherein said first dielectric layer comprises a material having a low dielectric constant approximately between two and five; and wherein said second dielectric layer comprises a material having a higher dielectric constant of multiple order of the first layer dielectric constant.

19. An apparatus as recited in claim 8, wherein the physical size and operating frequency of the apparatus are determined by the unit cell size and equivalent transmission line model parameters.

20. An apparatus as recited in claim 8, wherein the size, operating frequency bands, and impedance matching of said apparatus depends on the unit cell equivalent (TL) parameters $C_R$, $L_R$, $C_L$, and $L_L$.

21. An apparatus as recited in claim 20, wherein the sizing of said apparatus is controlled in response to varying $L_L$ and $C_L$ whose effectiveness is in response to the small propagating wavelength value compared to the free space wavelength.

22. An apparatus as recited in claim 21, wherein said optional second plurality of conductive elements comprises metal-insulator-metal (MIM) capacitors that provide a high $C_L$ to lower structure resonant frequency in response to utilizing a thin dielectric sheet with high dielectric constant.

23. An apparatus as recited in claim 8, wherein said feed line comprises a feed line having a characteristic impedance of 50 (ohms).

24. An apparatus for transmitting or radiating radio frequencies within a composite right/left-handed (CRLH) transmission line, comprising:

a first dielectric layer forming a structure substrate;

a second dielectric layer positioned over said first dielectric layer;

a ground plane disposed under said first dielectric layer;

a first plurality of conductive elements disposed over said second dielectric layer;

a second plurality of conductive elements disposed between said first and second dielectric layers and positioned to form metal-insulator-metal (MIM) capacitors in response to proximity with said first plurality of conductive elements, said capacitors lower the resonant frequency of said apparatus;

a plurality of vias interconnecting said first plurality of conductive elements with said ground conducting layer; and at least one feed line attached to said first plurality of conductive elements;

wherein said apparatus comprises a CRLH-based device configured according to an equivalent circuit model that comprises Right-Hand (RH) series induction ($L_R$) and shunt capacitor ($C_R$), and Left-Hand (LH) series capacitor ($C_L$) and induction ($L_L$); and wherein values for $C_R$, $L_R$, $C_L$, $L_L$, and N within said apparatus are selected to match a desired feed impedance.

25. An apparatus as recited in claim 24, wherein said first plurality of conductive elements are positioned in a two-dimensional array.

26. An apparatus as recited in claim 25, wherein said array is a three-by-three array.

27. An apparatus as recited in claim 25, wherein said array has a size of approximately $1/14\lambda \times 1/14\lambda \times 1/39\lambda$.

28. An apparatus for transmitting or radiating radio frequencies within a composite right/left-handed (CRLH) transmission line, comprising:

a first dielectric layer forming a structure substrate;

second dielectric layer positioned over said first dielectric layer;

a ground plane disposed under said first dielectric layer;

a first plurality of conductive elements disposed over said second dielectric layer;

a second plurality of conductive elements disposed between said first and second dielectric layers and positioned to form metal-insulator-metal (MIM) capacitors in response to proximity with said first plurality of conductive elements, said capacitors lower the resonant frequency of said apparatus;

a plurality of vias interconnecting said first plurality of conductive elements with said ground conducting layer; and at least one feed line attached to said first plurality of conductive elements;

wherein said apparatus comprises an antenna;

wherein said feed line is configured as a dual-feed connection to said first plurality of conductive elements; and whereby said antenna is circularly polarized in response to said dual-feed connection of said first and second feed lines to orthogonal edges of said antenna.

29. An apparatus as recited in claim 28, wherein said plurality of antenna elements comprises a three-by-three array and has a relative sizing of 1/10λ×1/10λ×1/36λ.

30. An apparatus as recited in claim 29, wherein incorporation of a coplanar waveguide (CPW) feed line configures said apparatus for integration with a desired set of electronics and/or associated matching networks.

31. An apparatus, comprising:

a first dielectric layer forming a structure substrate;

a second dielectric layer positioned over said first dielectric layer;

a ground plane disposed beneath said first dielectric layer;

a first plurality of conductive elements disposed over said second dielectric layer;

a second plurality of conductive elements disposed between said first and second dielectric layers and positioned to form metal-insulator-metal (MIM) capacitors in response to proximity with said first plurality of conductive elements, said capacitors lower the resonant frequency of said apparatus;

a plurality of vias interconnecting said first plurality of conductive elements with said ground plane; and at least one feed line attached to said first plurality of conductive elements;

said apparatus is configured using an equivalent circuit Right-Hand (RH) series induction ($L_R$) and shunt capacitor ($C_R$), and Left-Hand (LH) series capacitor ($C_L$) and induction ($L_L$), in which effective permittivity (e) and permeability (m) of the structure are manipulated by the choice of $C_R$, $L_R$, $C_L$, and $L_L$;

said first and second plurality of conductive elements comprise conductive plates or strips arranged in a one or two dimensional array of cells;

said first dielectric layer comprises a material having a first dielectric constant and a first thickness, and said second dielectric layer comprises a material having a second dielectric constant and a second thickness; and said second dielectric constant is higher than said first dielectric constant, and said second dielectric thickness is less than said first dielectric thickness.

* * * * *